US012729872B2

(12) United States Patent
Kagawa et al.

(10) Patent No.: US 12,729,872 B2
(45) Date of Patent: Sep. 8, 2026

(54) AIR-CONDITIONING CONTROL SYSTEM

(71) Applicant: DAIKIN INDUSTRIES, LTD, Osaka (JP)

(72) Inventors: Mikio Kagawa, Osaka (JP); Kazuhiro Furusho, Osaka (JP); Morito Matsuoka, Suita (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 149 days.

(21) Appl. No.: 18/685,460

(22) PCT Filed: Sep. 2, 2022

(86) PCT No.: PCT/JP2022/033172

§ 371 (c)(1),
(2) Date: Feb. 21, 2024

(87) PCT Pub. No.: WO2023/033155

PCT Pub. Date: Mar. 9, 2023

(65) Prior Publication Data

US 2024/0426504 A1 Dec. 26, 2024

(30) Foreign Application Priority Data

Sep. 2, 2021 (JP) ..... 2021-143013
Aug. 5, 2022 (JP) ..... 2022-125604

(51) Int. Cl.
*F24F 11/00* (2018.01)
*F24F 11/46* (2018.01)
*F24F 11/63* (2018.01)

(52) U.S. Cl.
CPC ..... *F24F 11/63* (2018.01); *F24F 11/46* (2018.01)

(58) Field of Classification Search
CPC ..... F24F 11/46; F24F 11/63
See application file for complete search history.

(56) References Cited

U.S. PATENT DOCUMENTS

2009/0327778 A1 12/2009 Shiga et al.
2019/0242608 A1 8/2019 Laftchiev et al.
(Continued)

FOREIGN PATENT DOCUMENTS

EP 2 987 042 B1 8/2019
EP 3 989 594 A1 4/2022
(Continued)

OTHER PUBLICATIONS

JP 2021 057008 (Year: 2021).*
(Continued)

*Primary Examiner* — Jonathan Bradford
(74) *Attorney, Agent, or Firm* — Spencer Fane LLP

(57) ABSTRACT

An air-conditioning control system performs air-conditioning of a target space by an air-conditioning apparatus. The air-conditioning control system includes a generation unit, a prediction unit, an evaluation unit, an extraction unit, and a control unit. The generation unit generates a plurality of candidates for an operation condition of the air-conditioning apparatus. The prediction unit uses a learning model in order to predict an environment state of the target space based on the operation condition, to predict the environment state. The evaluation unit evaluates the environment state corresponding to the operation condition. The extraction unit extracts, from the plurality of candidates for the operation condition, the operation condition for which an evaluation by the evaluation unit satisfies a predetermined condition. The control unit controls the air-conditioning apparatus with the operation condition extracted by the extraction unit.

13 Claims, 14 Drawing Sheets

(56) References Cited

U.S. PATENT DOCUMENTS

| | | | | |
|---|---|---|---|---|
| 2019/0377306 | A1 | 12/2019 | Harvey | |
| 2021/0140670 | A1* | 5/2021 | Matsuura | A47L 9/281 |
| 2022/0282884 | A1 | 9/2022 | Nishimura | |
| 2022/0316741 | A1* | 10/2022 | Nishimura | H04Q 9/00 |

FOREIGN PATENT DOCUMENTS

| | | | |
|---|---|---|---|
| JP | 2004-69273 | A | 3/2004 |
| JP | 2010-15192 | A | 1/2010 |
| JP | 2011-52862 | A | 3/2011 |
| JP | 2015-55431 | A | 3/2015 |
| JP | 2021-57008 | A | 4/2021 |
| JP | 2021-103083 | A | 7/2021 |

OTHER PUBLICATIONS

International Search Report of corresponding PCT Application No. PCT/JP2022/033172 dated Nov. 1, 2022.
International Preliminary Report of corresponding PCT Application No. PCT/JP2022/033172 dated Mar. 14, 2024.
European Search Report of corresponding EP Application No. 22 864 737.6 dated Sep. 8, 2025.

* cited by examiner

AIR-CONDITIONING CONTROL SYSTEM

CROSS-REFERENCE TO RELATED APPLICATIONS

This U.S. National stage application claims priority under 35 U.S.C. § 119(a) to Japanese Patent Application Nos. 2021-143013, filed in Japan on Sep. 2, 2021, and 2022-125604, filed in Japan on Aug. 5, 2022, the entire contents of which are hereby incorporated herein by reference.

BACKGROUND

Technical Field

The present disclosure relates to an air-conditioning control system.

Background Information

As indicated in Japanese Unexamined Patent Application Publication No. 2010-15192, there is a technique for determining an optimal operation condition of an air-conditioning apparatus so that the target space is in a desired environment state.

SUMMARY

In Japanese Unexamined Patent Application Publication No. 2010-15192, since the operation condition of the air-conditioning apparatus is determined based on an existing database, there is the problem that the target space cannot be brought sufficiently close to the desired environment state.

An air-conditioning control system of a first aspect performs air-conditioning of a target space using an air-conditioning apparatus. The air-conditioning control system includes a generation unit, a prediction unit, an evaluation unit, an extraction unit, and a control unit. The generation unit generates a plurality of candidates for an operation condition of the air-conditioning apparatus. The prediction unit predicts an environment state using the learning model. The learning model predicts the environment state of the target space based on the operation condition. The evaluation unit evaluates the environment state corresponding to the operation condition. The extraction unit extracts, from among the plurality of operation condition candidates, an operation condition for which an evaluation by the evaluation unit satisfies a predetermined condition. The control unit controls the air-conditioning apparatus with the operation condition extracted by the extraction unit.

The air-conditioning control system of the first aspect extracts the operation condition of the air-conditioning apparatus based on the environment state of the target space. As a result, the air-conditioning control system can determine an operation condition of the air-conditioning apparatus such that the target space approaches a desired environment state.

An air-conditioning control system of a second aspect is the air-conditioning control system of the first aspect, further including a learning unit The learning unit generates the learning model.

An air-conditioning control system of a third aspect is the air-conditioning control system of the first aspect or the second aspect, further including a computing unit. The computing unit performs a computational fluid dynamics (CFD) simulation of the environment state using the operation condition as an input. The learning model predicts the environment state that is an output of the CFD simulation, using the operation condition as an input.

With such a configuration, the air-conditioning control system of the third aspect can determine an operation condition of the air-conditioning apparatus such that the target space approaches a desired environment state, without actually controlling the air-conditioning apparatus for each operation condition.

An air-conditioning control system of a fourth aspect is the air-conditioning control system of the third aspect, wherein the learning model is a model that has performed learning using the operation condition as an explanatory variable and the environment state that is the output of the CFD simulation as an objective variable.

An air-conditioning control system of a fifth aspect is the air-conditioning control system of the first aspect or the second aspect, further including a computing unit. The computing unit performs a CFD simulation of the environment state using the operation condition as an input. The computing unit calculates a first environment state and a second environment state having a lower simulation accuracy than the first environment state. The learning model predicts the first environment state using the second environment state as an input.

The air-conditioning control system of the fifth aspect performs the CFD simulation of the environment state using the operation condition as an input. The air-conditioning control system calculates the second environment state having a lower CFD simulation accuracy, from the operation condition. The air-conditioning control system predicts the first environment state from the second environment state using the learning model. Therefore, the air-conditioning control system can reduce the time required for the CFD simulation compared with a case where the first environment state having a higher CFD simulation accuracy is calculated from the operation condition. As a result, the air-conditioning control system can determine an operation condition of the air-conditioning apparatus such that the target space approaches a desired environment state in a realistic time.

An air-conditioning control system of a sixth aspect is the air-conditioning control system of the fifth aspect, wherein the learning model is a model that has performed learning using the second environment state as an explanatory variable and the first environment state as an objective variable.

An air-conditioning control system of a seventh aspect is the air-conditioning control system of the first aspect or the second aspect, wherein the environment state is a value of an environment parameter at a plurality of locations including a first location and a second location within the target space. The air-conditioning control system further includes an acquisition unit. The acquisition unit acquires the value of the environment parameter at the first location by actual measurement. The learning model predicts the value of the environment parameter at the second location based on the value of the environment parameter at the first location acquired by the acquisition unit when the air-conditioning apparatus has been controlled with the operation condition.

In the air-conditioning control system of the seventh aspect, the learning model predicts the value of the environment parameter at the second location based on an actual measurement value of the environment parameter at the first location. As a result, the air-conditioning control system can predict the values of the environment parameter at all locations from the actual measurement value of the environment parameter at some of the locations.

An air-conditioning control system of an eighth aspect is the air-conditioning control system of the seventh aspect, wherein the learning model is a model that has performed learning using, as an explanatory variable, the value of the environment parameter at the first location acquired by the acquisition unit when the air-conditioning apparatus has been controlled with the operation condition, and, as an objective variable, the value of the environment parameter at the second location.

An air-conditioning control system of a ninth aspect is the air-conditioning control system of the seventh aspect, further including a computing unit. The computing unit performs a CFD simulation of the values of the environment parameter at the first location and the second location using the operation condition as an input. The learning model predicts the value of the environment parameter at the second location based on the value of the environment parameter at the first location acquired by the acquisition unit, and the values of the environment parameter at the first location and the second location calculated by the computing unit.

An air-conditioning control system of a tenth aspect is the air-conditioning control system of the ninth aspect, wherein the learning model is a model that has performed learning using, as an explanatory variable, the value of the environment parameter at the first location acquired by the acquisition unit, and, as an objective variable, the value of the environment parameter at the second location. The value of the environment parameter at the second location is predicted by inputting the value of the environment parameter at the second location calculated by the computing unit to a first learning model that has performed learning using, as an explanatory variable, the value of the environment parameter at the first location calculated by the computing unit, and, as an objective variable, the value of the environment parameter at the first location acquired by the acquisition unit.

An air-conditioning control system of an eleventh aspect is the air-conditioning control system of any of the first aspect to the tenth aspect, wherein the generation unit generates a candidate for the operation condition by reinforcement learning in which an evaluation by the evaluation unit is used as a value.

With such a configuration, the air-conditioning control system of the eleventh aspect can determine an operation condition of the air-conditioning apparatus such that the target space approaches a desired environment state, without depending on the experience of the operator and without generating candidates for all operation conditions.

An air-conditioning control system of a twelfth aspect is the air-conditioning control system of the eleventh aspect, wherein the generation unit generates the candidate for the operation condition using a learning model that determines a candidate for a next operation condition based on a current operation condition.

The air-conditioning control system of the twelfth aspect can easily generate the candidate for the operation condition by reinforcement learning using the learning model, even when the number of elements of the operation condition is large.

An air-conditioning control system of a thirteenth aspect is the air-conditioning control system of any of the first aspect to the twelfth aspect, wherein the target space includes an aisle between server racks in a data center.

The air-conditioning control system of the thirteenth aspect can realize, e.g., a reduction in power consumption of servers by bringing the environment state of the aisle between the server racks in the data center closer to a desired environment state.

An arrangement determination apparatus of a fourteenth aspect determines an arrangement of an air-conditioning apparatus in a target space. The arrangement determination apparatus includes a generation unit, a prediction unit, an evaluation unit, and an extraction unit. The generation unit generates a plurality of candidates for an arrangement condition of the air-conditioning apparatus. The prediction unit predicts an environment state using a learning model that predicts an environment state of the target space based on the arrangement condition. The evaluation unit evaluates the environment state corresponding to the arrangement condition. The extraction unit extracts, from among the plurality of arrangement condition candidates, an arrangement condition for which an evaluation by the evaluation unit satisfies a predetermined condition.

The arrangement determination apparatus of the fourteenth aspect extracts the arrangement condition of the air-conditioning apparatus based on the environment state of the target space. As a result, the arrangement determination apparatus can determine an arrangement condition of the air-conditioning apparatus such that the target space approaches a desired environment state.

An arrangement determination apparatus of a fifteenth aspect is the arrangement determination apparatus of the fourteenth aspect, further including a learning unit. The learning unit generates a learning model.

An arrangement determination apparatus of a sixteenth aspect is the arrangement determination apparatus of the fourteenth aspect or the fifteenth aspect, further including a computing unit. The computing unit performs a CFD simulation of the environment state using the arrangement condition as an input. The learning model predicts the environment state that is an output of the CFD simulation, using the arrangement condition as an input.

With such a configuration, the arrangement determination apparatus of the sixteenth aspect can determine an arrangement condition of the air-conditioning apparatus such that the target space approaches a desired environment state, without actually operating the air-conditioning apparatus for each arrangement condition.

An arrangement determination apparatus of a seventeenth aspect is the arrangement determination apparatus of the fourteenth aspect or the fifteenth aspect, further including a computing unit. The computing unit performs a CFD simulation of the environment state using the arrangement condition as an input. The computing unit calculates a first environment state and a second environment state having a lower simulation accuracy than the first environment state. The learning model predicts the first environment state using the second environment state as an input.

The arrangement determination apparatus of the seventeenth aspect performs the CFD simulation of the environment state, using the arrangement condition as an input. The arrangement determination apparatus calculates the second environment state having a lower CFD simulation accuracy, from the arrangement condition. The arrangement determination apparatus predicts the first environment state from the second environment state using the learning model. Thus, the arrangement determination apparatus can reduce the time required for the CFD simulation compared with a case where the first environment state having a higher CFD simulation accuracy is calculated from the arrangement condition. As a result, the arrangement determination apparatus can determine an arrangement condition of the air-conditioning apparatus such that the target space approaches a desired environment state in a realistic time.

An arrangement determination apparatus of an eighteenth aspect is the arrangement determination apparatus of any one of the fourteenth to seventeenth aspects, wherein the generation unit generates the candidates for the arrangement condition by reinforcement learning in which an evaluation by the evaluation unit is used as a value.

With such a configuration, the arrangement determination apparatus of the eighteenth aspect can determine an arrangement condition of the air-conditioning apparatus such that the target space approaches the desired environment state, without depending on the experience of the operator and without generating candidates for all arrangement conditions.

An arrangement determination apparatus of a nineteenth aspect is the arrangement determination apparatus of the eighteenth aspect, wherein the generation unit generates the candidates for the arrangement condition using a learning model that determines a candidate for a next arrangement condition based on a current arrangement condition.

The arrangement determination apparatus of the nineteenth aspect can easily generate the candidates for the arrangement condition by reinforcement learning using a learning model, even when the number of elements of the arrangement condition is large.

An arrangement determination apparatus of a twentieth aspect is the arrangement determination apparatus of any one of the fourteenth to nineteenth aspects, wherein the target space includes an aisle between server racks in a data center.

The arrangement determination apparatus of the twentieth aspect can realize, e.g., a reduction in power consumption of servers by bringing the environment state of the aisle between the server racks in the data center closer to a desired environment state.

DETAILED DESCRIPTION OF EMBODIMENT(S)

FIRST EMBODIMENT (1) Background

Figure 1:
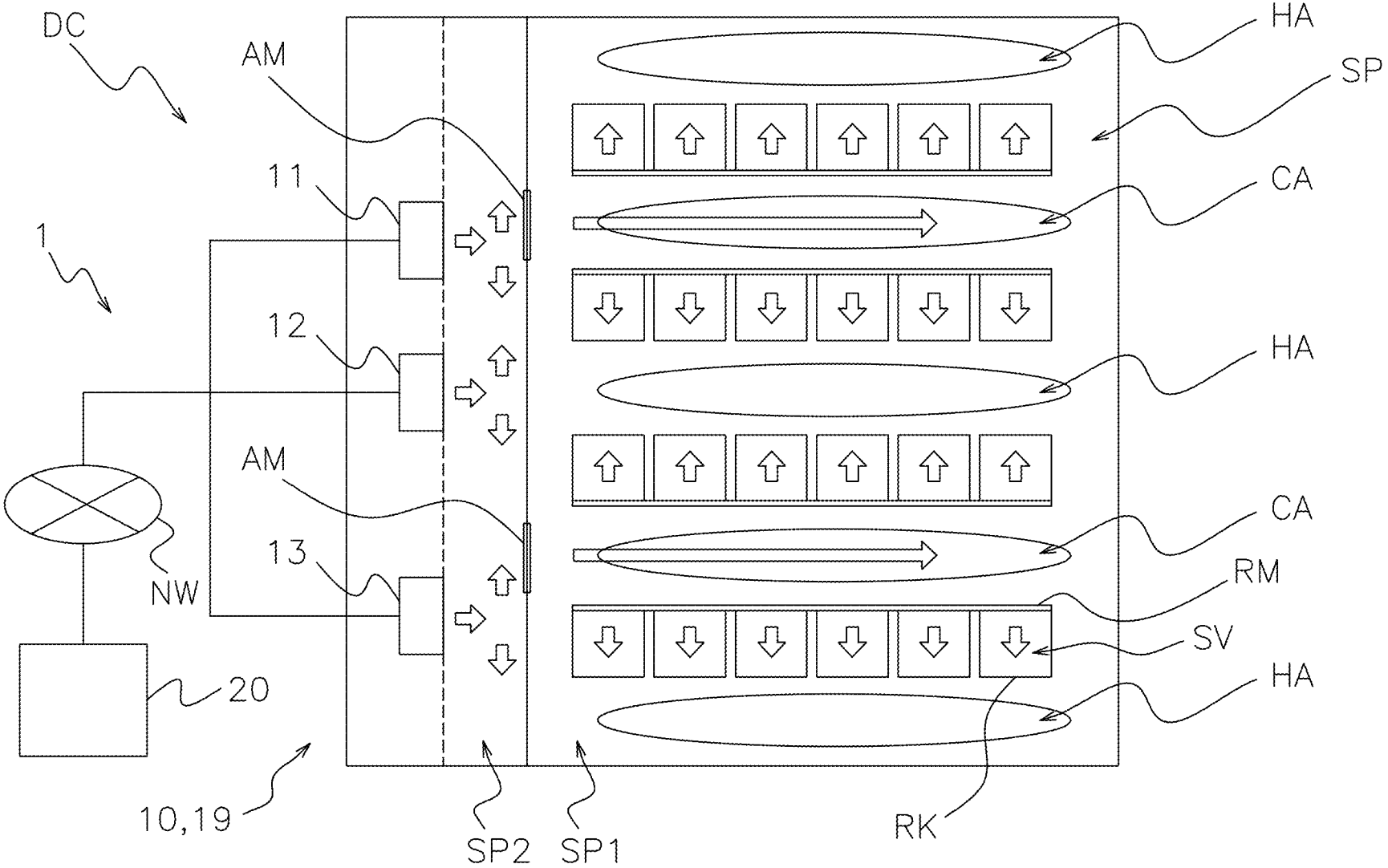
FIG. 1 is a schematic plan view of a data center in a first embodiment.

In recent years, the Internet of Things (IoT) has been developed in which various things such as automobiles, electronic devices, and sensors are connected to the Internet to transmit and receive information. With the development of the IoT, the number of Machine to Machine (M2M) connections representing the scale of inter-machine communications is expected to increase rapidly in the future. In fact, the number of M2M connections worldwide is expected to increase by a factor of 2.4 between 2018 and 2023. Further, it is expected that the number of M2M connections will be 14.7 billion in 2023, or 1.8 units per person of the population. As the number of M2M connections increases, the amount of data transmitted and received will also increase, and the amount of computing resources required in data centers for processing these data will also increase. As a result, it is thought that the scale of the data centers will expand and the power consumption in the data centers will further increase. Therefore, there exists a challenge to suppress power consumption in the data centers.

In general, two techniques have been proposed as methods for suppressing the power consumption of a data center. A first technique is to reduce the power consumption of a server by increasing the efficiency of task allocation to the server. The second is to optimize the setting value of an air-conditioning apparatus (which hereinafter may be referred to as an air-conditioning setting value) for conditioning the air in the server room of a data center. Existing research has focused primarily on optimizing the cooling efficiency of the air-conditioning apparatus. It is said that the power consumption of the servers occupies about 30% of the total power consumption of a data center, and the air-conditioning setting value has a large impact on the power consumption of the servers. The power consumption of a server depends on the number of rotations of an internal fan of the server, and the number of rotations of the internal fan depends on the supply air speed and the ambient temperature. Therefore, the power consumption of the server largely depends on the wind speed distribution in the data center, in addition to the temperature in the data center. In general, if the wind speed distribution in the server room is uniform, cool wind from the air-conditioning apparatus can be uniformly applied to the servers, so that the servers can be efficiently cooled. Therefore, it is important to make the wind speed distribution in the server room uniform in order to suppress the power consumption of the servers.

(2) Overall Configuration

An air-conditioning control system 1 mainly includes an air-conditioning apparatus 10 and an optimization apparatus 20. The air-conditioning apparatus 10 and the optimization apparatus 20 are communicably connected by a network NW. In the air-conditioning control system 1, the optimization apparatus 20 determines an optimal air-conditioning setting value such that the target space approaches a desired environment state. Then, the air-conditioning control system 1 performs cooling (air-conditioning) of the target space using the air-conditioning apparatus 10 based on the optimal air-conditioning setting value.

Figure 2:
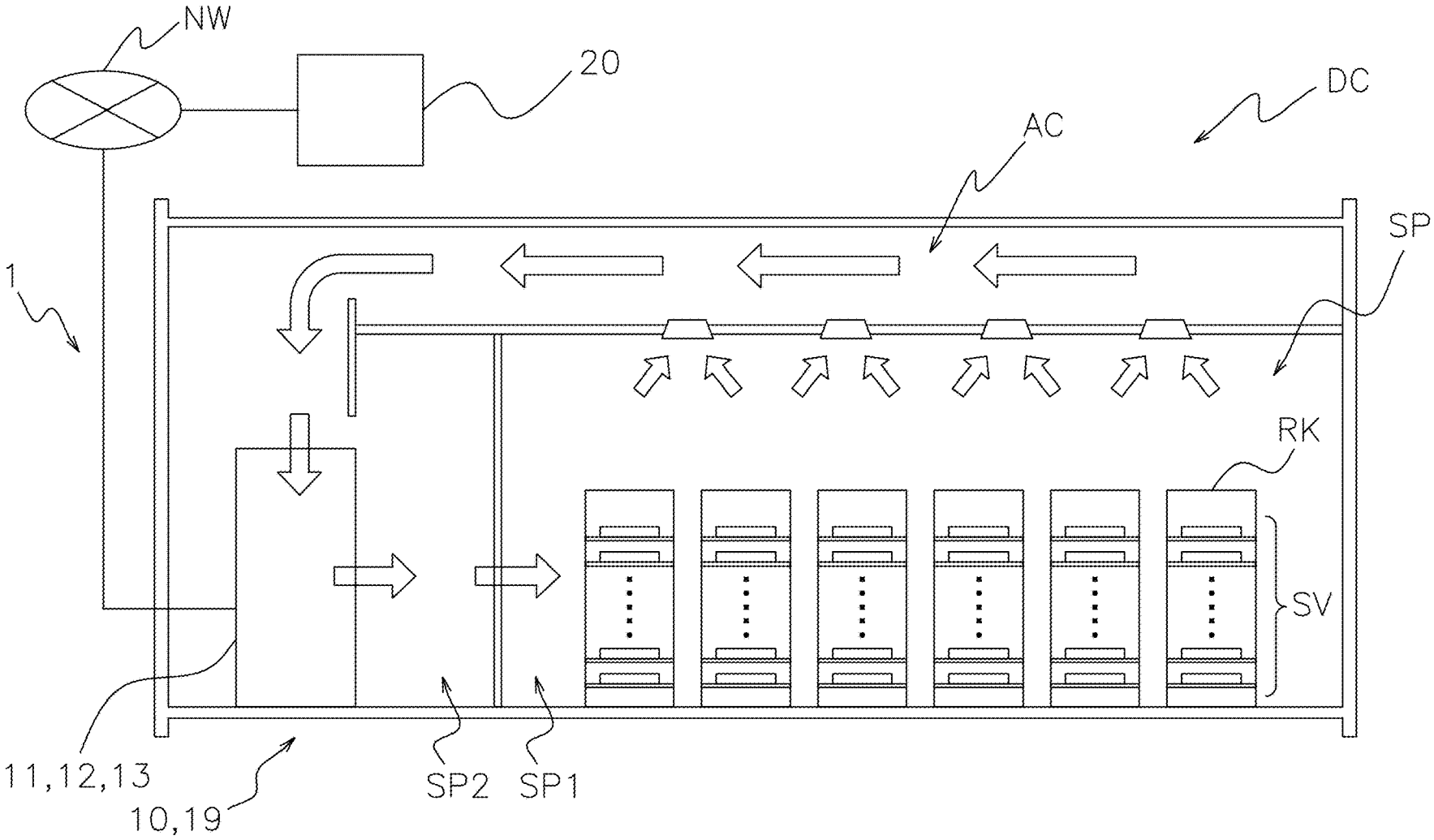
FIG. 2 is a schematic cross-sectional view of the data center in the first embodiment.

In the present embodiment, the target space is a server room SP of a data center DC. FIG. 1 is a schematic plan view of the data center DC. FIG. 2 is a schematic cross-sectional view of the data center DC. As shown in FIGS. 1 and 2, the server room SP has a server installation area SP1 and an air conditioner installation area SP2. In the server installation area SP1, six server racks RK are arranged in each row (hereinafter, a group of the server racks RK may be referred to as a module). On both sides of the module, there is a cold aisle CA and a hot aisle HA. Twenty-two servers SV are housed in each server rack RK. Therefore, a total of 528 servers SV are present in the server installation area SP1. Three indoor units 11 to 13, which are part of the air-conditioning apparatus 10, are installed in the air conditioner installation area SP2. Two aisle meshes AM capable of adjusting the permeability of wind are stretched between the air conditioner installation area SP2 and the cold aisle CA of the server installation area SP1. Further, a rack mesh RM capable of adjusting the permeability of wind is stretched on the cold aisle CA side of each server rack RK. As indicated by arrows in FIGS. 1 and 2, cool wind blown out from the indoor units 11 to 13 is rectified once in the space in front of the indoor units 11 to 13. The rectified cool wind passes through the aisle meshes AM and the rack meshes RM, and is supplied to the servers SV. The air heated inside the servers SV and discharged from the servers SV travels from the hot aisles HA and is sucked back into the indoor units 11 to 13 through an attic AC.

The environment state of the server room SP is, for example, a wind speed distribution, a temperature distribution, or the like of the server room SP. In addition, a desired environment state of the server room SP is a state in which the wind speed distribution in the server room SP is uniform, a state in which the temperature distribution in the server room SP is biased toward a specific place, or the like. In the present embodiment, the desired environment state of the server room SP is a state in which the wind speed distribution in the hot aisles HA of the server room SP is uniform. The optimization apparatus 20 determines an optimal air-conditioning setting value such that the wind speed distribution in the hot aisles HA of the server room SP is uniform. Therefore, the optimization apparatus 20 needs to predict the wind speed distribution in the server room SP from the air-conditioning setting value. The optimization apparatus 20 uses a CFD simulation to predict the wind speed distribution in the server room SP from the air-conditioning setting value.

In the CFD simulation, the server room SP is divided into a large number of small spaces (which hereinafter may be referred to as spatial meshes), and an environment parameter such as wind speed or temperature is predicted for each spatial mesh. In the present embodiment, the environment parameter is wind speed. As the number of spatial meshes increases, a more accurate result can be obtained. However, a CFD simulation with a large number of spatial meshes requires an enormous amount of time for a single computation. On the other hand, since the servers SV are densely installed in the server racks RK in the data center DC, it is necessary to obtain a precise result, and it is not possible to reduce the number of the spatial meshes.

Therefore, in the present embodiment, the optimization apparatus 20 performs a low-accuracy (relatively small number of spatial meshes) CFD simulation (which may hereinafter be referred to as a low-accuracy CFD). Then, the optimization apparatus 20 uses the result of the low-accuracy CFD to perform regression prediction of the result of a high-accuracy (relatively large number of spatial meshes) CFD simulation (which may hereinafter be referred to as a high-accuracy CFD). A neural network model (which may hereinafter be referred to as an NN model) is used for the regression prediction. Thus, the execution time for the high-accuracy CFD can be reduced.

In the present embodiment, the optimization apparatus 20 uses a reinforcement learning model (which may hereinafter be referred to as a deep reinforcement learning (DRL) model) in order to reduce the number of times of execution of the CFD simulation. The optimization apparatus 20 can determine the optimal air-conditioning setting value in a realistic time without searching all combinations of the air-conditioning setting value.

(3) Detailed Configuration (3-1) Air-Conditioning Apparatus

Figure 3:
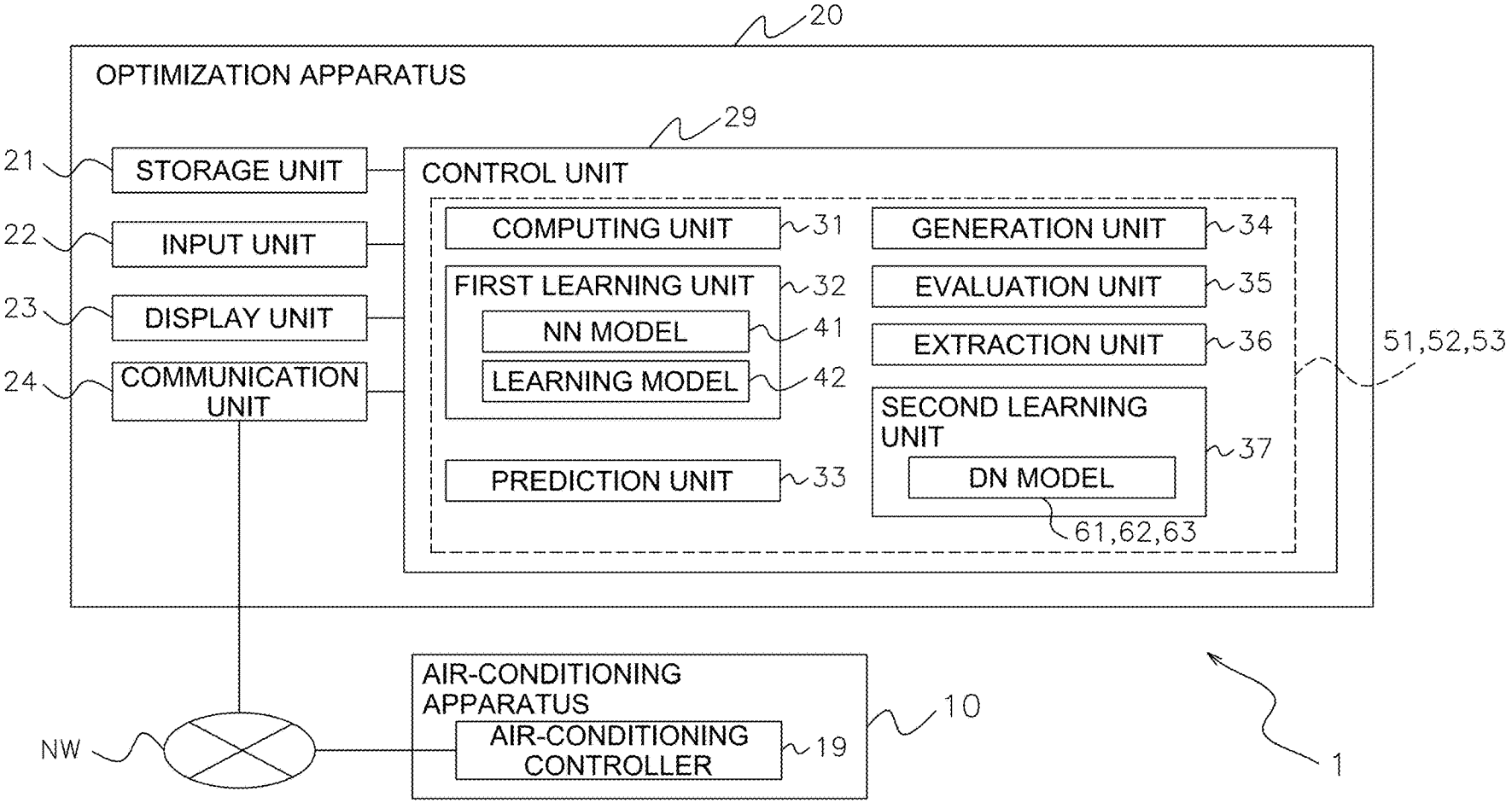
FIG. 3 is a functional block diagram of an air-conditioning control system in the first embodiment.

FIG. 3 is a functional block diagram of the air-conditioning control system 1. As shown in FIGS. 1 to 3, the air-conditioning apparatus 10 mainly includes indoor units 11 to 13 and an air-conditioning controller 19. In the present embodiment, the air-conditioning apparatus 10 includes the aisle meshes AM and the rack meshes RM as components.

The indoor units 11 to 13 are so-called package-type apparatus. The indoor units 11 to 13 are installed on the floor of the air conditioner installation area SP2. Each of the indoor units 11 to 13 mainly includes a compressor, a condenser, an expansion valve, an evaporator, and a fan. The compressor, the condenser, the expansion valve, and the evaporator are connected by a refrigerant circuit.

The compressor draws in a low-pressure refrigerant, compresses the refrigerant by a compression mechanism, and discharges a compressed refrigerant. The compression mechanism of the compressor is driven by a compressor motor. The rotational speed of the compressor motor can be controlled by an inverter.

In the condenser, heat exchange is performed between the refrigerant flowing inside the condenser and, for example, water that has been cooled by a heat source unit installed on the rooftop or the like of the data center DC. At this time, the refrigerant flowing inside the condenser becomes a liquid refrigerant by condensation.

The expansion valve adjusts the pressure and flow rate of the refrigerant flowing through the refrigerant circuit. The expansion valve is an electronic expansion valve with an adjustable opening degree.

The fan supplies air in the air conditioner installation area SP2 to the evaporator. The fan is driven by a fan motor. The rotational speed of the fan motor can be controlled by an inverter.

In the evaporator, heat exchange is performed between the refrigerant flowing through the evaporator and the air in the air conditioner installation region SP2 supplied by the fan. As shown in FIG. 2, the indoor units 11 to 13 drive the fans to suck the air in the air conditioner installation area SP2 via suction ports in the upper portions of the units. The sucked air in the air conditioner installation area SP2 passes through the evaporator. At this time, the refrigerant flowing inside the evaporator becomes a gas refrigerant by evaporation. The air that has passed through the evaporator is cooled, and cool wind is blown out from the outlets of the indoor units 11 to 13.

The air-conditioning controller 19 controls the operation of various devices constituting the air-conditioning apparatus 10.

The air-conditioning controller 19 includes a control and computing apparatus and a storage apparatus. The control and computing apparatus is a processor, such as a CPU or a GPU. The storage apparatus is a storage medium, such as a RAM, a ROM, or a flash memory. The control and computing apparatus reads a program stored in the storage apparatus, and performs predetermined computing processing according to the program to thereby control the operations of various devices constituting the air-conditioning apparatus 10. In addition, the control and computing apparatus can write computation results to the storage apparatus, and read information stored in the storage apparatus according to the program.

The air-conditioning controller 19 is electrically connected to various devices constituting the air-conditioning apparatus 10 so as to be able to exchange control signals and information therewith. The air-conditioning controller 19 is communicably connected to various sensors provided in the air-conditioning apparatus 10. Further, the air-conditioning controller 19 exchanges various information, including the air-conditioning setting value, and various signals, with the control unit 29 of the optimization apparatus 20 via the network NW. The air-conditioning controller 19 receives the optimal air-conditioning setting value from the optimization apparatus 20, and controls various devices constituting the air-conditioning apparatus 10 with the optimal air-conditioning setting value. The air-conditioning setting value includes, for example: the blown wind speed, the setting temperature, the setting humidity, or the like of each of the indoor units 11 to 13; and the transmittance or the like of each of the aisle meshes AM and the rack meshes RM.

(3-2) Optimization Apparatus

The optimization apparatus 20 of the present embodiment is a computer installed on the cloud. The optimization apparatus 20 may be installed in the data center DC, for example. As shown in FIG. 3, the optimization apparatus 20 mainly includes a storage unit 21, an input unit 22, a display unit 23, a communication unit 24, and a control unit 29.

(3-2-1) Storage Unit

The storage unit 21 is a storage apparatus, such as a RAM, a ROM, or a hard disk drive (HDD). The storage unit 21 stores a program executed by the control unit 29, data necessary for execution of the program, and the like.

(3-2-2) Input Unit

The input unit 22 is a keyboard and a mouse. Various commands and various information for the optimization apparatus 20, such as the initial value of an air-conditioning setting value to be searched, can be input using the input unit 22.

(3-2-3) Display Unit

The display unit 23 is a monitor. The display unit 23 can display the results of a CFD simulation and the like.

(3-2-4) Communication Unit

The communication unit 24 is a network interface device for communicating with the air-conditioning apparatus 10 via the network NW.

(3-2-5) Control Unit

The control unit 29 is a processor, such as a CPU or a GPU. In the present embodiment, "Intel Core™ i7-8700K 3.7 GHz" is used as the processor. The control unit 29 reads and executes a program stored in the storage unit 21 to implement various functions of the optimization apparatus 20. In addition, the control unit 29 can write a computation result to the storage unit 21 or read information stored in the storage unit 21, according to the program.

The control unit 29 exchanges various information, including the air-conditioning setting value, and various signals with the air-conditioning controller 19 of the air-conditioning apparatus 10 via the network NW.

As shown in FIG. 3, the control unit 29 includes, as functional blocks, a computing unit 31, a first learning unit 32, a prediction unit 33, a generation unit 34, an evaluation unit 35, an extraction unit 36, and a second learning unit 37. The computing unit 31, the first learning unit 32, the prediction unit 33, the generation unit 34, the evaluation unit 35, the extraction unit 36, and the second learning unit 37 are functional blocks for implementing the DRL models 51 to 53.

(3-2-5-1) Computing Unit

The computing unit 31 performs a CFD simulation of the wind speed distribution (environment state) in the server room SP, using an air-conditioning setting value (operation condition) as an input.

The air-conditioning setting value in the present embodiment has five elements: the blown wind speed of each of the indoor units 11 to 13; and the transmittance of each of the aisle meshes AM and the rack meshes RM. Each element of the air-conditioning setting value satisfies the condition of Expression 1 below.

MATH 1

$$S = (M_{aisle}, M_{rack}, P_1, P_2, P_3) \quad \text{MATH 1}$$

$$M_{aisle}, M_{rack} \in [30, 90]\ (\%)$$

$$P_1 + P_2 + P_3 = 9.0\ (\text{m/s})$$

wherein, S denotes the air-conditioning setting value, $M_{aisle}$ denotes the transmittance of the aisle mesh AM, $M_{rack}$ denotes the transmittance of the rack mesh RM, and $P_1$ to $P_3$ respectively denote the blown wind speeds of the indoor units 11 to 13.

In the present embodiment, Flow Designer provided by Advanced Knowledge Laboratory is used as the software for performing the CFD simulation. The result of the CFD simulation (wind speed for each spatial mesh) is output to a CSV file or the like.

The computing unit 31 calculates a high-accuracy wind speed distribution (first environment state; which may be hereinafter referred to as a high-accuracy wind speed distribution), which is the result of the high-accuracy CFD of the server room SP, and a low-accuracy wind speed distribution (second environment state; which may be hereinafter referred to as a low-accuracy wind speed distribution), which is the result of the low-accuracy CFD of the server room SP.

When searching for the optimal air-conditioning setting value, the computing unit 31 calculates the low-accuracy wind speed distribution to be input to an NN model 41, for each air-conditioning setting value searched. In addition, in order to learn the NN model 41 in advance, the computing unit 31 calculates a pair (a learning data set for the NN model 41) of the low-accuracy wind speed distribution and the high-accuracy wind speed distribution for each plurality of air-conditioning setting values.

(3-2-5-2) First Learning Unit

The first learning unit 32 generates the NN model 41 using the learning data set for the NN model 41 calculated by the computing unit 31. At this time, the first learning unit 32 learns the NN model 41 with the low-accuracy wind speed distribution as an explanatory variable and the high-accuracy wind speed distribution as an objective variable.

In the present embodiment, in order to create the learning data set for the NN model 41, 896 air-conditioning setting values satisfying the following Expression 2 were used under the constraint of Expression 1.

MATH 2

$$M_{aisle}, M_{rack} \in \{35, 45, 50, 60, 65, 75, 80, 90\}\ (\%) \qquad \text{MATH 2}$$

$$P_1, P_2, P_3 \in \{1, 2, 3, 4, 5, 6, 7\}\ (\text{m/s})$$

The computing unit 31 performed three types of low-accuracy CFD and one type of high-accuracy CFD shown in Table 1 below, for each of the air-conditioning setting values.

TABLE 1

| | Number of spatial meshes |
|---|---|
| Low-accuracy CFD | 23,750 |
| | 49,000 |
| | 101,250 |
| | 500,000 |
| High-accuracy CFD | 1,000,000 |

Figure 4:
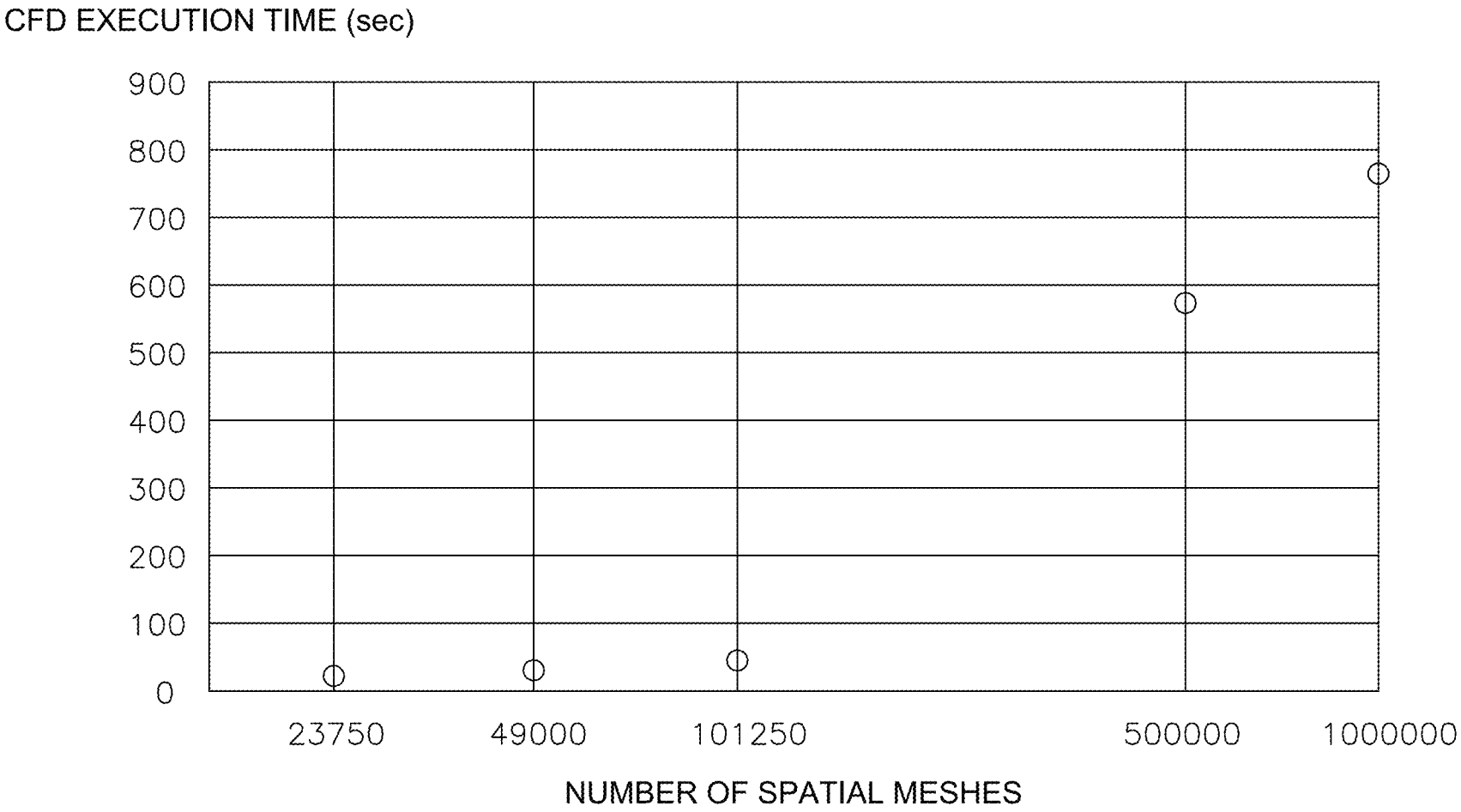
FIG. 4 is a graph showing the relationship between the number of spatial meshes and the CFD execution time in the first embodiment.

FIG. 4 is a graph illustrating the relationship between the number of spatial meshes and the execution time for the CFD simulation (which may hereinafter be referred to as the CFD execution time) for one air-conditioning setting value. As shown in FIG. 4, as the number of spatial meshes increases, the CFD execution time increases. For example, when the number of spatial meshes is 23,750, the CFD execution time is about 20 seconds, and when the number of spatial meshes is 1,000,000, the CFD execution time is about 780 seconds.

Figure 5:
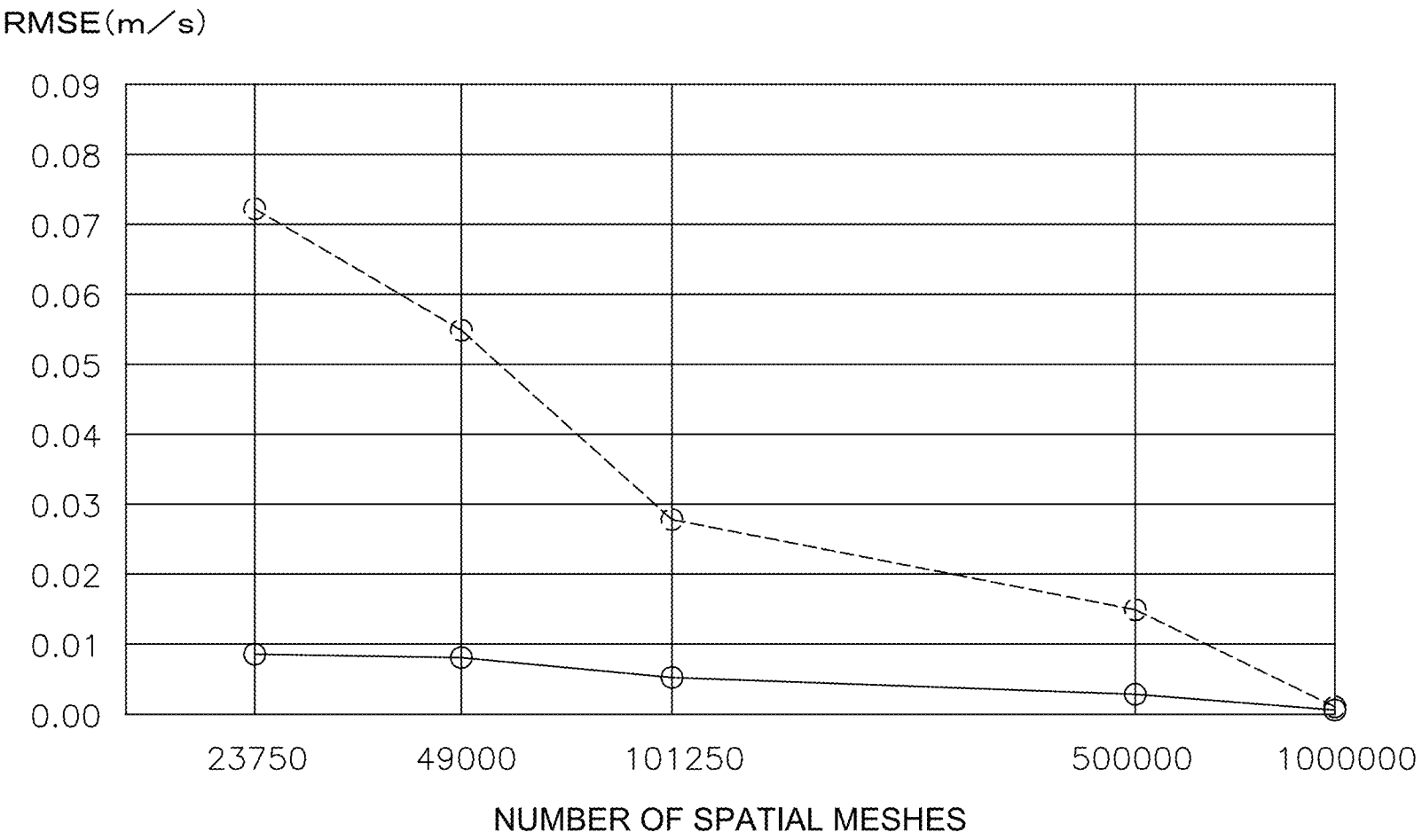
FIG. 5 is a graph showing the accuracy of an NN model in the first embodiment.

In the present embodiment, 80% of the learning data set for the NN model 41 is used as learning data, and 20% thereof is used as test data. FIG. 5 is a graph showing the accuracy of the NN model 41. The evaluation index of the accuracy is the root mean square error (RMSE). The solid line graph in FIG. 5 indicates the accuracy of the NN model 41 that has learned the low-accuracy wind speed distribution and the high-accuracy wind speed distribution in association with each other. The broken line graph in FIG. 5 indicates the accuracy of a learning model that has learned the air-conditioning setting value and the high-accuracy wind speed distribution in association with each other. For example, when the number of spatial meshes is 23,750, the RMSE of the solid line graph is about 0.009 m/s, and the RMSE of the broken line graph is about 0.07 m/s. Therefore, when the number of spatial meshes is 23,750, it is seen that the NN model 41 has significantly higher accuracy than the learning model that predicts the high-accuracy wind speed distribution from the air-conditioning setting value. Further, it is seen that the accuracy of the NN model 41 when the number of spatial meshes is 23,750 is substantially the same as the accuracy when the number of spatial meshes is 500,000.

In other words, it is seen that the time for calculating the high-accuracy wind speed distribution from the low-accuracy wind speed distribution using the NN model 41 is about 20 times shorter than the time for calculating the high-accuracy wind speed distribution from the air-conditioning setting value using the high-accuracy CFD.

From the considerations of FIGS. 4 and 5, in the present embodiment, when the high-accuracy wind speed distribution is predicted, the low-accuracy wind speed distribution with 23,750 spatial meshes is used.

(3-2-5-3) Prediction Unit

The prediction unit 33 predicts the high-accuracy wind speed distribution using the NN model 41 generated by the first learning unit 32. Specifically, the prediction unit 33 inputs the low-accuracy wind speed distribution, calculated by the computing unit 31 based on the air-conditioning setting value, to the NN model 41, and predicts the high-accuracy wind speed distribution.

(3-2-5-4) Generation Unit

Since tens of thousands to hundreds of thousands of combinations of the air-conditioning setting values are conceivable, it is not realistic to search all of them. Therefore, a DRL model is used as a technique for searching for the optimal air-conditioning setting value. In the present embodiment, in the DRL model, the learning model used for selecting a next action is a dueling network model (which may hereinafter be referred to as a DN model).

When a search is performed using a single DRL model, there are still tens of thousands to hundreds of thousands of combinations of the air-conditioning setting values. Therefore, in the present embodiment, three DRL models 51 to 53 are used. Then, the number of combinations of the air-conditioning setting values is reduced by changing the search range and the search width of the air-conditioning setting values in a stepwise manner for each of the DRL models 51 to 53. In this way, since the number of combinations in each of the DRL models 51 to 53 is suppressed to about one thousand and several hundred, the number of times of execution of the CFD simulation is significantly reduced. The search range and the search width of the air-conditioning setting values in each of the DRL models 51 to 53 are shown in Table 2 below.

TABLE 2

| Model | Air-conditioning setting value | Search range | Search width |
|---|---|---|---|
| DRL model 51 | Transmittance | 30% to 90% | 10% |
| | Blown wind speed | 1 m/s to 6 m/s | 1 m/s |
| DRL model 52 | Transmittance | Optimal air-conditioning setting value in DRL model 51 ± 12% | 4% |
| | Blown wind speed | Optimal air-conditioning setting value in DRL model 51 ± 1.2 m/s (at least 0.5 m/s) | 0.4 m/s |
| DRL model 53 | Transmittance | Optimal air-conditioning setting value in DRL model 52 ± 3% | 1% |
| | Blown wind speed | Optimal air-conditioning setting value in DRL model 52 ± 0.3 m/s (at least 0.5 m/s) | 0.1 m/s |

By using the DRL models 51 to 53, it is possible to finally determine an optimal air-conditioning setting value in 1% units for the transmittance of the aisle mesh AM and the rack mesh RM, and in 0.1 m/s units for the blown wind speed of the indoor units 11 to 13.

The state (air-conditioning setting value) and action in the DRL models 51 to 53 are expressed by the following Expression 3.

MATH 3

$$S = (M_{aisle}, M_{rack}, P_1, P_2, P_3) \qquad \text{MATH 3}$$

$$a \in \{M_{aisle}^{+}, M_{aisle}^{-}, M_{rack}^{+}, M_{rack}^{-}, P_1^{+}, P_1^{-}, P_2^{+}, P_2^{-}, P_3^{+}, P_3^{-}\}$$

where S indicates the state, a indicates the action, and $M_{aisle}^{+}$ or the like indicates the action of increasing or decreasing the corresponding air-conditioning setting value by the search width. For example, $M_{aisle}^{+}$ in the DRL model 51 means increasing $M_{aisle}$ by 10%.

In the present embodiment, the total number of times of search for determining the optimal air-conditioning setting value is 5,000 steps for all of the DRL models 51 to 53.

The generation unit 34 generates candidates for the air-conditioning setting values to be searched, using the DRL models 51 to 53 having an evaluation by the evaluation unit 35 as a value (reward). Specifically, the generation unit 34 uses DN models 61 to 63, which determine a candidate for a next air-conditioning setting value based on the current air-conditioning setting value, to generate candidates for air-conditioning setting values having a high expected reward. The DN models 61 to 63 are learning models corresponding to the DRL models 51 to 53, respectively.

(3-2-5-5) Evaluation Unit

The evaluation unit 35 evaluates the high-accuracy wind speed distribution corresponding to an air-conditioning setting value.

The evaluation unit 35 first calculates an evaluation value for the air-conditioning setting value based on the air-conditioning setting value and the high-accuracy wind speed distribution corresponding to the air-conditioning setting value.

In the present embodiment, the evaluation value is defined by the following Expression 4.

MATH 4

$$\text{Evaluation value}=\alpha\times\text{variance score}+\beta\times\text{mesh score}+\gamma\times\text{air-conditioning score}$$

$$\text{Variance score}=f(\text{var(server backside wind speed)})$$

$$\text{Mesh score}=g(M_{aisle}+M_{rack})$$

$$\text{Air-conditioning score}=h((P_1)^3+(P_2)^3+(P_3)^3) \quad \text{<Math. 4>}$$

$$\alpha+\beta+\gamma=1(\alpha=0.6,\ \beta=0.1,\ \gamma=0.3)$$

The evaluation value is obtained by averaging the variance score, the mesh score, and the air-conditioning score with weights α, β, and γ. Each of the variance score, the mesh score, and the air-conditioning score is configured to take a value of 0 or more and 100 or less (as a result, the evaluation value also takes a value of 0 or more and 100 or less). The larger the evaluation value, the variance score, the mesh score, and the air-conditioning score are, the higher the evaluation is.

The variance score depends on the variance of a set of wind speeds, included in the high-accuracy wind speed distribution, for the specific spatial mesh present on the back side (hot aisle HA side) of each server SV. The variance score is configured to have a larger value as the variance becomes smaller. The variance score represents the uniformity of the wind speed distribution in the hot aisles HA in the server room SP. As the variance score increases, the hot aisles HA of the server room SP have a more uniform wind speed distribution.

The mesh score depends on the sum of the transmittance of the aisle meshes AM and the transmittance of the rack meshes RM. The mesh score is configured to have a larger value as the transmittance of the aisle meshes AM or the transmittance of the rack meshes RM increases. As the mesh score increases, wind passes through the aisle meshes AM and the rack meshes RM more easily, and thus the variance score decreases.

The air-conditioning score depends on the sum of the cube of the blown wind speed of each of the indoor units 11 to 13. The air-conditioning score is configured to increase as the blown wind speed of the indoor units 11 to 13 decreases (as the power consumption of the air-conditioning apparatus 10 decreases). The air-conditioning score is defined in this way because the power consumption of the air-conditioning apparatus 10 is proportional to the cube of the blown wind speed.

In the present embodiment, since homogenization of the wind speed distribution in the hot aisles HA is emphasized, α is set to 0.6 (which is a relatively large value), β is set to 0.1, and γ is set to 0.3.

After calculating the evaluation values, the evaluation unit 35 calculates a reward for the DRL models 51 to 53 based on the evaluation value, as shown in Table 3 below.

TABLE 3

| Conditions | Reward |
|---|---|
| If the current evaluation value is larger than the average of the evaluation values of the past 10 steps. | 1 |
| If the current evaluation value is equal to or less than the average of the evaluation values of the past 10 steps. | 0 |
| If the search for the air-conditioning setting value has gone outside the predetermined search range. | −3 |

In the present embodiment, the DRL models 51 to 53 are stabilized by comparing the current evaluation value with the average of the evaluation values of the past 10 steps.

(3-2-5-6) Extraction Unit

The extraction unit 36 extracts, for each of the DRL models 51 to 53, an optimal air-conditioning setting value having the highest evaluation value by the evaluation unit 35, from among a plurality of air-conditioning setting value candidates generated by the generation unit 34. The control unit 29 finally transmits the optimal air-conditioning setting value in the DRL model 53 to the air-conditioning apparatus 10.

(3-2-5-7) Second Learning Unit

During the search by the DRL models 51 to 53, the second learning unit 37 associates the state with the reward that is expected when each action is taken from the state, and stocks the state and the reward in the storage unit 21 for each of the DRL models 51 to 53.

The second learning unit 37 learns and updates the DN models 61 to 63, as needed, using the data stocked in the storage unit 21.

(4) Verification Result

In the present embodiment, as the initial value of the air-conditioning setting value in the DRL model 51, the air-conditioning setting value of the following Expression 5 is used.

MATH 5

$$S=(M_{aisle},\ M_{rack},\ P_1,\ P_2,\ P_3)=(90,\ 90,\ 3,\ 3,\ 3) \quad \text{MATH 5}$$

The air-conditioning setting value is a value at which the mesh score and the air-conditioning score are 100.

The following Table 4 shows the optimal air-conditioning setting values and evaluation values thereof extracted in the DRL models 51 to 53.

TABLE 4

| Model | Optimal air-conditioning setting value | Evaluation value |
|---|---|---|
| DRL model 51 | (80, 30, 3, 3, 3) | 91.93 |

TABLE 4-continued

| Model | Optimal air-conditioning setting value | Evaluation value |
|---|---|---|
| DRL model 52 | (92, 30, 3.4, 2.6, 3) | 92.85 |
| DRL model 53 | (90, 30, 3.7, 2.5, 2.8) | 90.95 |

As shown in Table 4, the DRL models 51 to 53 extract air-conditioning setting values having relatively high evaluation values.

Figure 6:
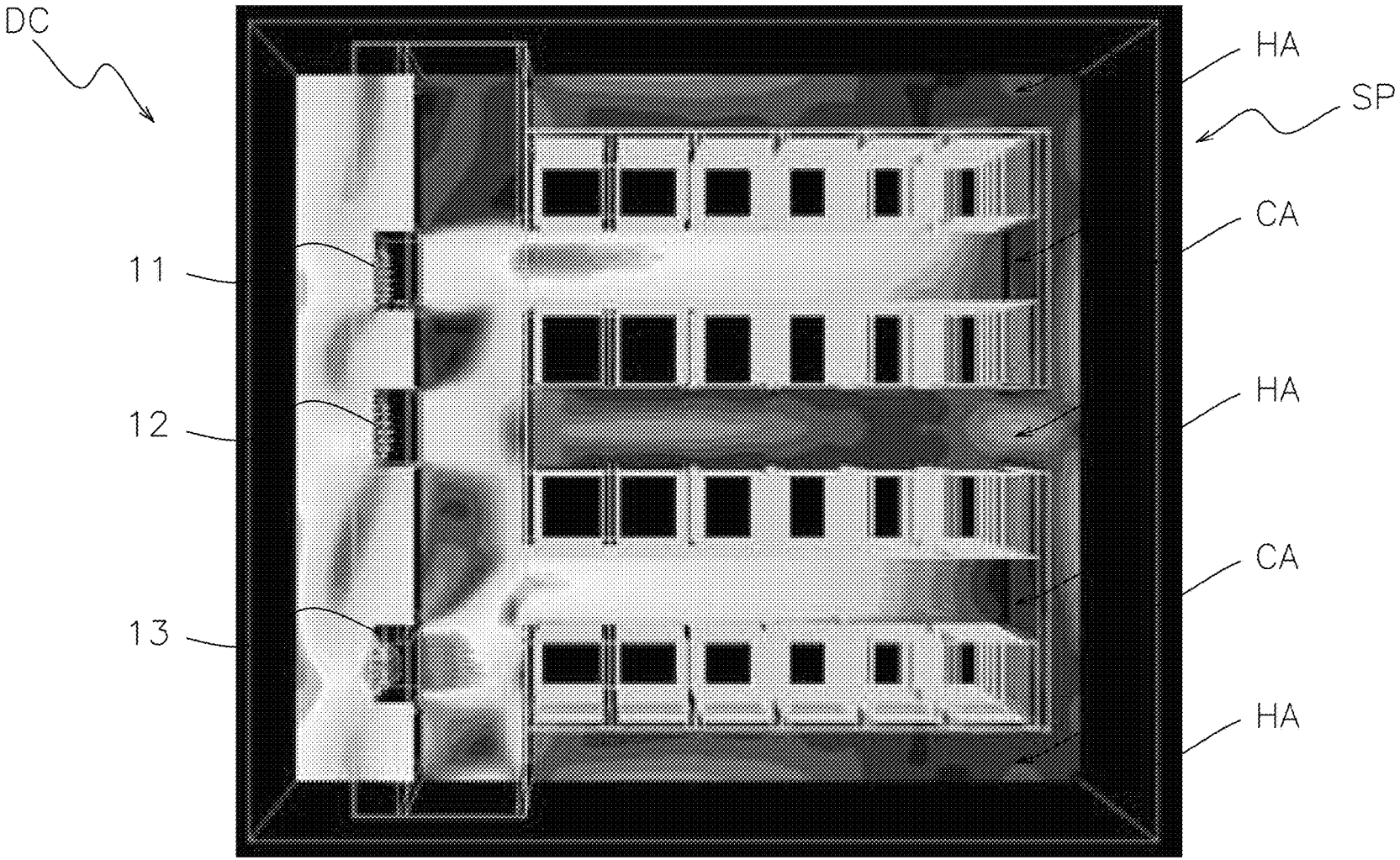
FIG. 6 is a heat map showing a wind speed distribution in a server room in the first embodiment.

FIG. 6 is a heat map showing the wind speed distribution in the server room SP when the optimal air-conditioning setting value in the DRL model 53 is set in the air-conditioning apparatus 10. As shown in FIG. 6, the wind speed distribution in the hot aisles HA is substantially uniform (the degrees of shading are the same).

Table 5 below shows the number of times of search and the number of times of execution of the CFD simulation for each of the DRL models 51 to 53.

TABLE 5

| Model | Number of times of search | Number of times of execution of CFD |
|---|---|---|
| DRL model 51 | 1,372 | 227 |
| DRL model 52 | 1,764 | 264 |
| DRL model 53 | 1,864 | 105 |
| Total | 5,000 | 596 |

As shown in Table 5, it was possible to significantly reduce the number of times of execution of the CFD simulation by performing the stepwise search using the DRL models 51 to 53. In this verification, in the process of searching the air-conditioning setting values, an air-conditioning setting value that appeared for the first time and the corresponding high-accuracy wind speed distribution were stored in the storage unit 21. In the process of searching the air-conditioning setting values, if the air-conditioning setting value stored in the storage unit 21 appeared again, the CFD simulation was not performed, and the corresponding high-accuracy wind speed distribution was read from the storage unit 21, thereby reducing the number of times of execution of the simulation.

The DRL models 51 to 53 require 0.3 seconds for each search. In addition, the calculation of the high-accuracy wind speed distribution requires 20.3 seconds (10 seconds for the input of the air-conditioning setting value, 5 seconds for the low-accuracy CFD, 5 seconds for the output to the CSV file or the like, and 0.3 seconds for the calculation of the high-accuracy wind speed distribution by the NN model 60) for each calculation. Therefore, the air-conditioning control system 1 in the present embodiment was able to determine the optimal air-conditioning setting value in the DRL model 53 in about 3.77 hours (=(5000×0.3 seconds+596×20.3 seconds)/3600).

(5) Processing

Figure 7:
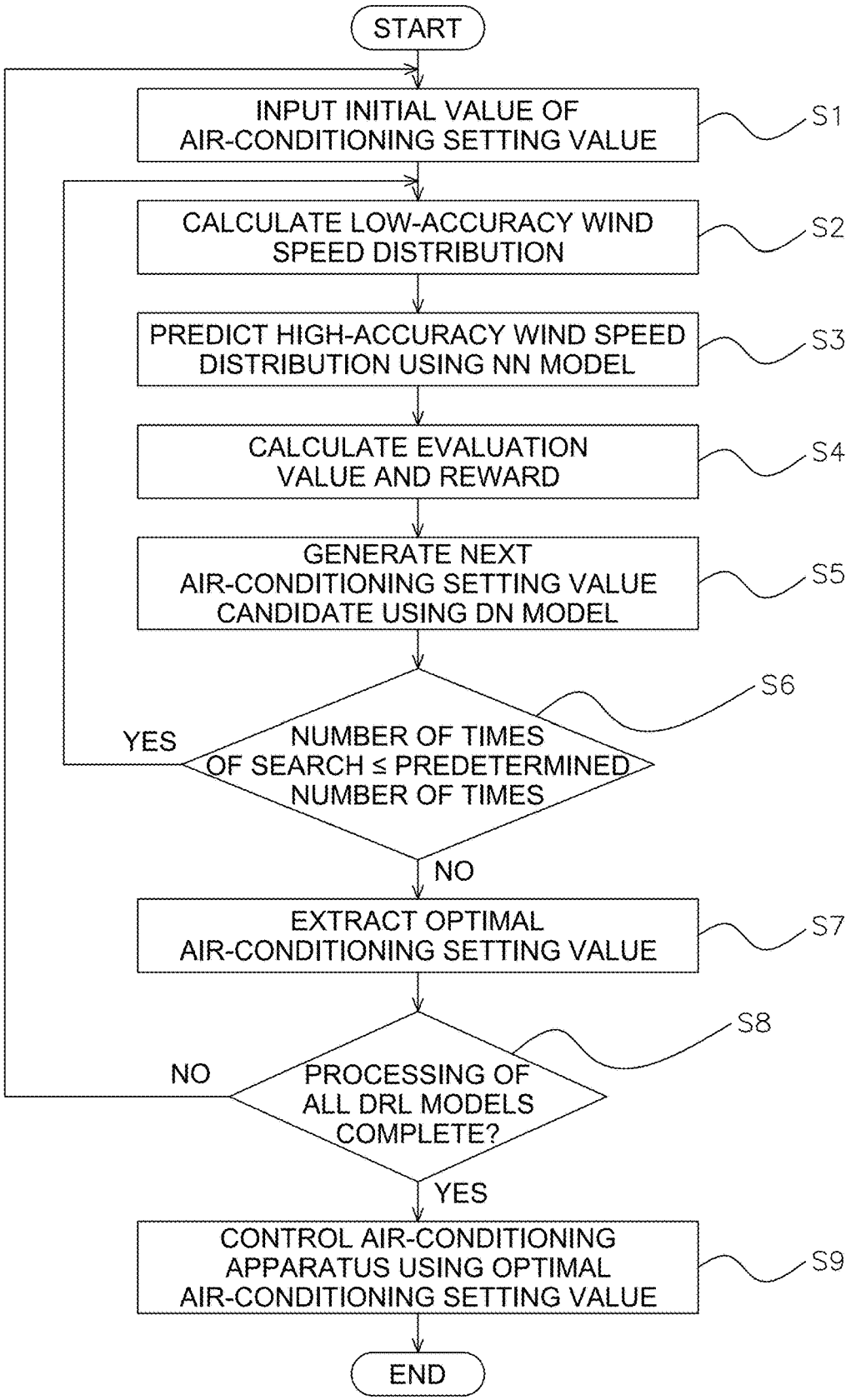
FIG. 7 is a flowchart of a process for controlling an air-conditioning apparatus with an optimal air-conditioning setting value in the first embodiment.

An example of a process of controlling the air-conditioning apparatus 10 with the optimal air-conditioning setting value will be described with reference to the flowchart of FIG. 7. In this flowchart, corresponding to the sequential execution of the DRL models 51 to 53, steps S1 to S8 are repeated three times.

The processing from step S1 to step S8 for the first time is processing related to the DRL model 51.

As indicated in step S1, the initial value of the air-conditioning setting value in the DRL model 51 is input to the optimization apparatus 20.

When step S1 is finished, the air-conditioning control system 1 calculates the low-accuracy wind speed distribution from the air-conditioning setting value, as indicated in step S2.

When step S2 is finished, the air-conditioning control system 1 predicts the high-accuracy wind speed distribution from the low-accuracy wind speed distribution using the NN model 41, as indicated in step S3.

When step S3 is finished, the air-conditioning control system 1 calculates an evaluation value and a reward for the air-conditioning setting value from the air-conditioning setting value and the high-accuracy wind speed distribution, as indicated in step S4.

When step S4 is finished, the air-conditioning control system 1 generates candidates for air-conditioning setting values having a high expected reward, using the DN model 61, as indicated in step S5.

When step S5 is finished, the air-conditioning control system 1 determines whether or not the number of times of search by the DRL model 51 is equal to or less than a predetermined number of times (a total number of times of search by the DRL model 51 set in advance), as indicated in step S6. If the number of times of search by the DRL model 51 is equal to or less than the predetermined number of times, the process proceeds to step S2. If the number of times of search by the DRL model 51 is larger than the predetermined number, the process proceeds to step S7.

When the process proceeds from step S6 to step S2, the air-conditioning control system 1 calculates the low-accuracy wind speed distribution from the air-conditioning setting value generated in step S5. In other words, the air-conditioning control system 1 repeats steps S2 to S6 until the number of times of search by the DRL model 51 becomes larger than the predetermined number.

When the process proceeds from step S6 to step S7, the air-conditioning control system 1 extracts an optimal air-conditioning setting value having the highest evaluation value from among the air-conditioning setting values searched in the DRL model 51.

When step S7 is finished, the air-conditioning control system 1 determines whether or not the processing of all the DRL models 51 to 53 is completed, as indicated in step S8. At this stage, since only the DRL model 51 is completed, the process proceeds to step S1.

The processing from step S1 to step S8 for the second time is processing related to the DRL model 52. Since the processing is basically the same as the first processing from step S1 to step S8, only different parts will be described.

In step S1, the air-conditioning control system 1 inputs the optimal air-conditioning setting value of the DRL model 51 that has been extracted in the first step S7 to the optimization apparatus 20 as the initial value of the air-conditioning setting value in the DRL model 52.

In step S5, the air-conditioning control system 1 uses the DN model 62 to generate candidates for air-conditioning setting values having a high expected reward.

In step S6, the air-conditioning control system 1 determines whether or not the number of times of search by the DRL model 52 is equal to or less than a predetermined number of times (the total number of times of search by the DRL model 52 set in advance).

In step S7, the air-conditioning control system 1 extracts an optimal air-conditioning setting value having the highest evaluation value from among the air-conditioning setting values searched in the DRL model 52.

In step S8, the air-conditioning control system 1 determines whether or not the processing of all the DRL models 51 to 53 has been completed. At this stage, since only the DRL models 51 and 52 have been completed, the process proceeds to step S1.

The third processing from step S1 to step S8 is processing related to the DRL model 53. Since the processing is basically the same as the first processing from step S1 to step S8, only different parts will be described.

In step S1, the air-conditioning control system 1 inputs the optimal air-conditioning setting value of the DRL model 52 that has been extracted in the second step S7, to the optimization apparatus 20 as the initial value of the air-conditioning setting value in the DRL model 53.

In step S5, the air-conditioning control system 1 uses the DN model 63 to generate candidates for air-conditioning setting values having a high expected reward.

In step S6, the air-conditioning control system 1 determines whether or not the number of times of search by the DRL model 53 is equal to or less than a predetermined number of times (a total number of times of search by the DRL model 53 set in advance).

In step S7, the air-conditioning control system 1 extracts an optimal air-conditioning setting value having the highest evaluation value from among the air-conditioning setting values searched in the DRL model 53.

In step S8, the air-conditioning control system 1 determines whether or not the processing of all the DRL models 51 to 53 has been completed. At this stage, since the processing of all the DRL models 51 to 53 is completed, the process proceeds to step S9.

Proceeding from step S8 to step S9, the air-conditioning control system 1 transmits the optimal air-conditioning setting value of the DRL model 53 that has been extracted in the third step S7, from the optimization apparatus 20 to the air-conditioning apparatus 10, and controls the air-conditioning apparatus 10 with the optimal air-conditioning setting value.

The air-conditioning control system 1 learns and updates the DN models 61 to 63, as needed, during the processing of the DRL models 51 to 53.

(6) Features (6-1)

Conventionally, there is a technology for determining the optimal operation condition of an air-conditioning apparatus so that the target space is in a desired environment state.

However, the conventional technology suffers from the problem that, since the operation condition of the air-conditioning apparatus is determined based on an existing database, the target space cannot be brought sufficiently close to the desired environment state. In addition, the conventional technology has the problem that the entire target space cannot be brought sufficiently close to the desired environment state at the same time.

The air-conditioning control system 1 of the present embodiment performs air-conditioning of the server room SP using the air-conditioning apparatus 10. The air-conditioning control system 1 includes the generation unit 34, the first learning unit 32, the prediction unit 33, the evaluation unit 35, the extraction unit 36, and the air-conditioning controller 19. The generation unit 34 generates a plurality of candidates for the air-conditioning setting value of the air-conditioning apparatus 10. The first learning unit 32 generates the NN model 41. The prediction unit 33 predicts the wind speed distribution using the NN model 41. The NN model 41 predicts the wind speed distribution in the server room SP based on the air-conditioning setting value. The evaluation unit 35 evaluates the wind speed distribution corresponding to the air-conditioning setting value. The extraction unit 36 extracts the air-conditioning setting value having the highest evaluation by the evaluation unit 35 from among a plurality of candidates for the air-conditioning setting value. The air-conditioning controller 19 controls the air-conditioning apparatus 10 with the air-conditioning setting value extracted by the extraction unit 36.

The air-conditioning control system 1 extracts the air-conditioning setting value based on the wind speed distribution in the server room SP. As a result, the air-conditioning control system 1 can determine optimal air-conditioning setting value such that the server room SP approaches a desired wind speed distribution. Further, the air-conditioning control system 1 can bring the entire server room SP closer to the desired wind speed distribution at the same time.

(6-2)

The air-conditioning control system 1 of the present embodiment further includes the computing unit 31. The computing unit 31 performs the CFD simulation of the wind speed distribution, using air-conditioning setting value as an input. The computing unit 31 calculates a high-accuracy wind speed distribution and a low-accuracy wind speed distribution. The NN model 41 predicts the high-accuracy wind speed distribution, using the low-accuracy wind speed distribution as an input. The NN model 41 is a model that has performed learning using the low-accuracy wind speed distribution as an explanatory variable and the high-accuracy wind speed distribution as an objective variable.

The air-conditioning control system 1 performs a CFD simulation of the wind speed distribution in the server room SP, using air-conditioning setting value as an input. The air-conditioning control system 1 calculates the low-accuracy wind speed distribution from the air-conditioning setting value. The air-conditioning control system 1 predicts the high-accuracy wind speed distribution from the low-accuracy wind speed distribution using the NN model 41.

Therefore, the air-conditioning control system 1 can reduce the time required for the CFD simulation compared with the case where the high-accuracy wind speed distribution is calculated from the air-conditioning setting value. As a result, the air-conditioning control system 1 can determine the optimal air-conditioning setting value such that the server room SP approaches a desired wind speed distribution in a realistic time.

(6-3)

In the air-conditioning control system 1 of the present embodiment, the generation unit 34 generates candidates for air-conditioning setting values by reinforcement learning in which the evaluation by the evaluation unit 35 is used as a value.

As a result, the air-conditioning control system 1 can determine the optimal air-conditioning setting value such that the server room SP approaches a desired wind speed distribution, without depending on the experience of the operator and without generating candidates for all air-conditioning setting values.

(6-4)

In the air-conditioning control system 1 of the present embodiment, the generation unit 34 generates candidates for the air-conditioning setting value using the DN models 61 to 63, which determine the candidates for the next air-conditioning setting value based on the current air-conditioning setting value.

As a result, the air-conditioning control system 1 can easily generate the candidates for the optimal air-conditioning setting value using the DRL models 51 to 53 in which the DN models 61 to 63 are used, even when the number of elements of the air-conditioning setting value is large.

(6-5)

In the air-conditioning control system 1 of the present embodiment, the target space includes the aisles between the server racks RK in the data center DC.

As a result, the air-conditioning control system 1 can suppress the power consumption of the servers SV by bringing the wind speed distribution of the cold aisles CA and the hot aisles HA of the server room SP closer to the desired wind speed distribution.

(7) Modifications (7-1) Modification 1A

In the present embodiment, the air-conditioning apparatus 10 performs air-conditioning of the server room SP using the indoor units 11 to 13, which are of the floor-standing and package-type. However, the air-conditioning apparatus 10 may perform air-conditioning of the server room SP by a so-called building multi-system or a central air-conditioning system. Further, the indoor units 11 to 13 may be of ceiling-mounted type or wall-mounted type.

(7-2)

In the present embodiment, the target space of the air-conditioning control system 1 is the server room SP in the data center DC. However, the target space of the air-conditioning control system 1 is not limited thereto, and may be a space in a commercial facility, an office space, or the like.

(7-3)

In the present embodiment, the air-conditioning control system 1 calculates the low-accuracy wind speed distribution from the air-conditioning setting value and inputs the low-accuracy wind speed distribution to the NN model 41 to predict the high-accuracy wind speed distribution. However, the air-conditioning control system 1 may use the learning model 42 that predicts the high-accuracy wind speed distribution using the air-conditioning setting value as an input. The learning model 42 is, for example, a neural network.

At this time, the computing unit 31, in order to learn the learning model 42 in advance, calculates the high-accuracy wind speed distribution (a learning data set of the learning model 42) for each plurality of air-conditioning setting values.

The first learning unit 32 generates the learning model 42 using the learning data set of the learning model 42 calculated by the computing unit 31. At this time, the first learning unit 32 learns the learning model 42 using the air-conditioning setting value as an explanatory variable and the high-accuracy wind speed distribution as an objective variable.

The prediction unit 33 predicts the high-accuracy wind speed distribution using the learning model 42 generated by the first learning unit 32. Specifically, the prediction unit 33 inputs the air-conditioning setting value to the learning model 42 and predicts the high-accuracy wind speed distribution.

As a result, the air-conditioning control system 1 can determine the optimal air-conditioning setting value such that the server room SP approaches the desired wind speed distribution, without actually controlling the air-conditioning apparatus 10 for each air-conditioning setting value.

(7-4)

In the present embodiment, the environment state is the wind speed distribution in the server room SP. The evaluation value for the air-conditioning setting value is defined so that the evaluation of the corresponding air-conditioning setting value is high when the wind speed distribution in the server room SP is the desired wind speed distribution (Expression 4).

However, the environment state may be a temperature distribution in the server room SP. In this case, the evaluation value for the air-conditioning setting value is defined so that the evaluation of the corresponding air-conditioning setting value is high when the temperature distribution in the server room SP is the desired temperature distribution. The desired temperature distribution is, for example, a uniform temperature distribution or a temperature distribution that eliminates a hot spot where the temperature of a specific portion is high.

In this way, by setting the evaluation value for the air-conditioning setting value as desired, a desired environment state can be realized.

(7-5)

While an embodiment of the present disclosure has been described above, it will be understood that various changes in form and detail may be made therein without departing from the spirit and scope of the present disclosure as set forth in the appended claims.

SECOND EMBODIMENT

Hereinafter, differences from the first embodiment will be mainly described. The present embodiment is basically the same as the first embodiment except for the contents described for the present embodiment.

(1) Overall Configuration

The air-conditioning control system 2 mainly includes the air-conditioning apparatus 10 and an optimization apparatus 120. The air-conditioning control system 2 uses the optimization apparatus 120 to determine an optimal air-conditioning setting value such that the server room SP approaches a desired environment state.

Figure 8:
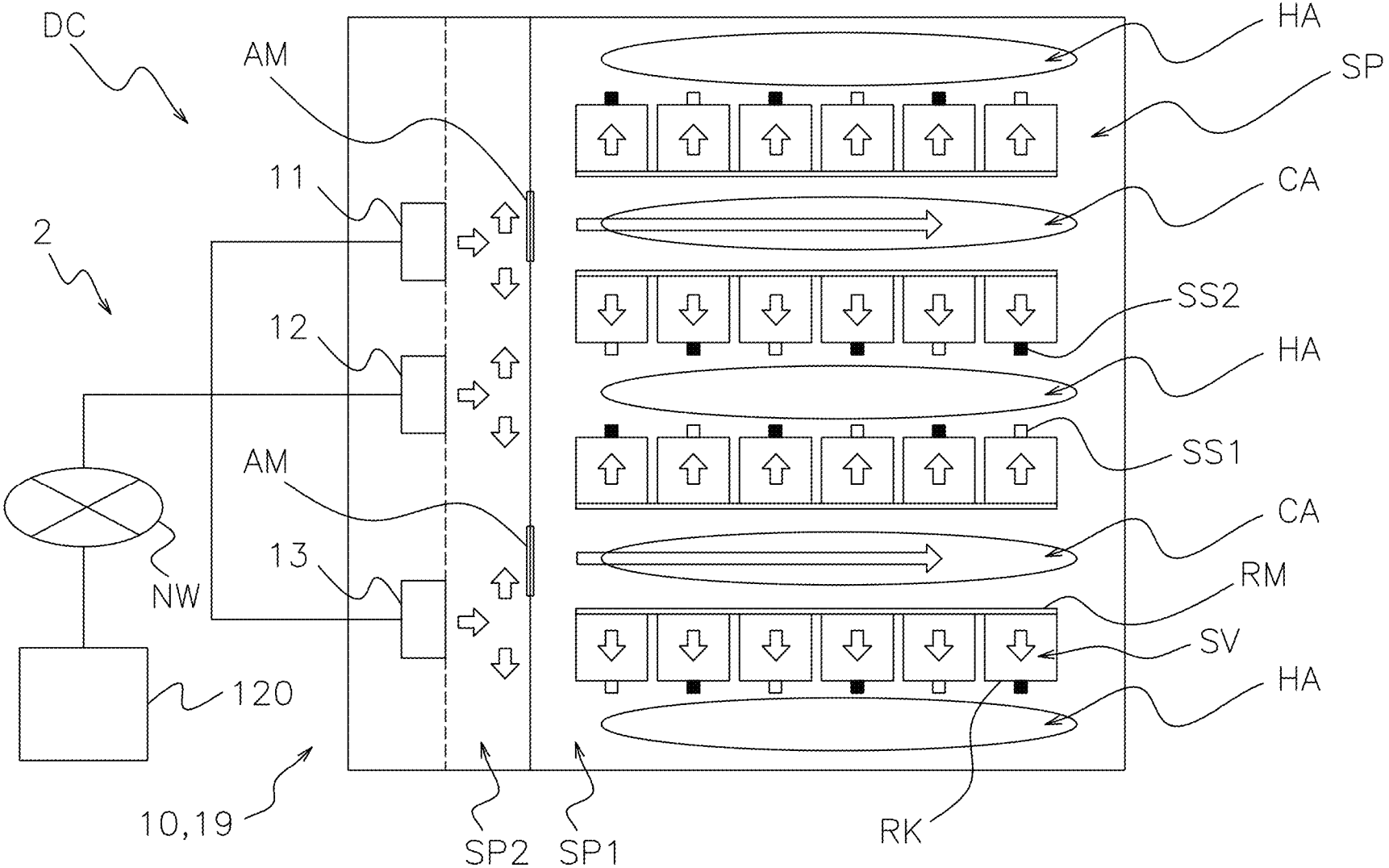
FIG. 8 is a schematic plan view of a data center in a second embodiment.

FIG. 8 is a schematic plan view of the data center DC in the present embodiment. The second embodiment differs from the first embodiment in that environment sensors for measuring the surrounding wind speed, temperature, and the like are installed on the back surface (hot aisle HA side) of some of the server racks RK. In the present embodiment, the environment sensors are wind speed sensors SS1. In addition, in FIG. 8, virtual wind speed sensors SS2 (which may hereinafter be referred to as virtual wind speed sensors SS2) that are not actually installed are shown on the rear surface of the server racks RK on which the wind speed sensors SS1 are not installed. In FIG. 8, the virtual wind speed sensors SS2 are filled to distinguish the wind speed sensors SS1 and the virtual wind speed sensors SS2 from each other. In the air-conditioning control system 2, the environment state of the server room SP is the values of the wind speeds (environment parameter) at the installation location (first location) of the wind speed sensors SS1 and the installation location (second location) of the virtual wind speed sensors SS2 in the server room SP. In other words, the environment state of the server room SP is the measurement values of the wind speed sensors SS1 and the virtual wind speed sensors SS2. The desired environment state of the server room SP is a state in which the measurement values of the wind speed sensors SS1 and the virtual wind speed sensors SS2 are uniform. In other words, the desired environment state of the server room SP is a state in which the wind speed distribution in the hot aisles HA is uniform, as in the first embodiment.

(2) Detailed Configuration (2-1) Air-Conditioning Apparatus

In the present embodiment, the air-conditioning apparatus 10 further includes the wind speed sensors SS1 as a component. The air-conditioning controller 19 is communicably connected to the wind speed sensors SS1. The air-conditioning controller 19 can acquire the measurement values of the wind speed sensors SS1 by actual measurement (hereinafter, the measurement values of the wind speed sensors SS1 by actual measurement may be referred to as actual measurement sensor values).

(2-2) Optimization Apparatus

Figure 9:
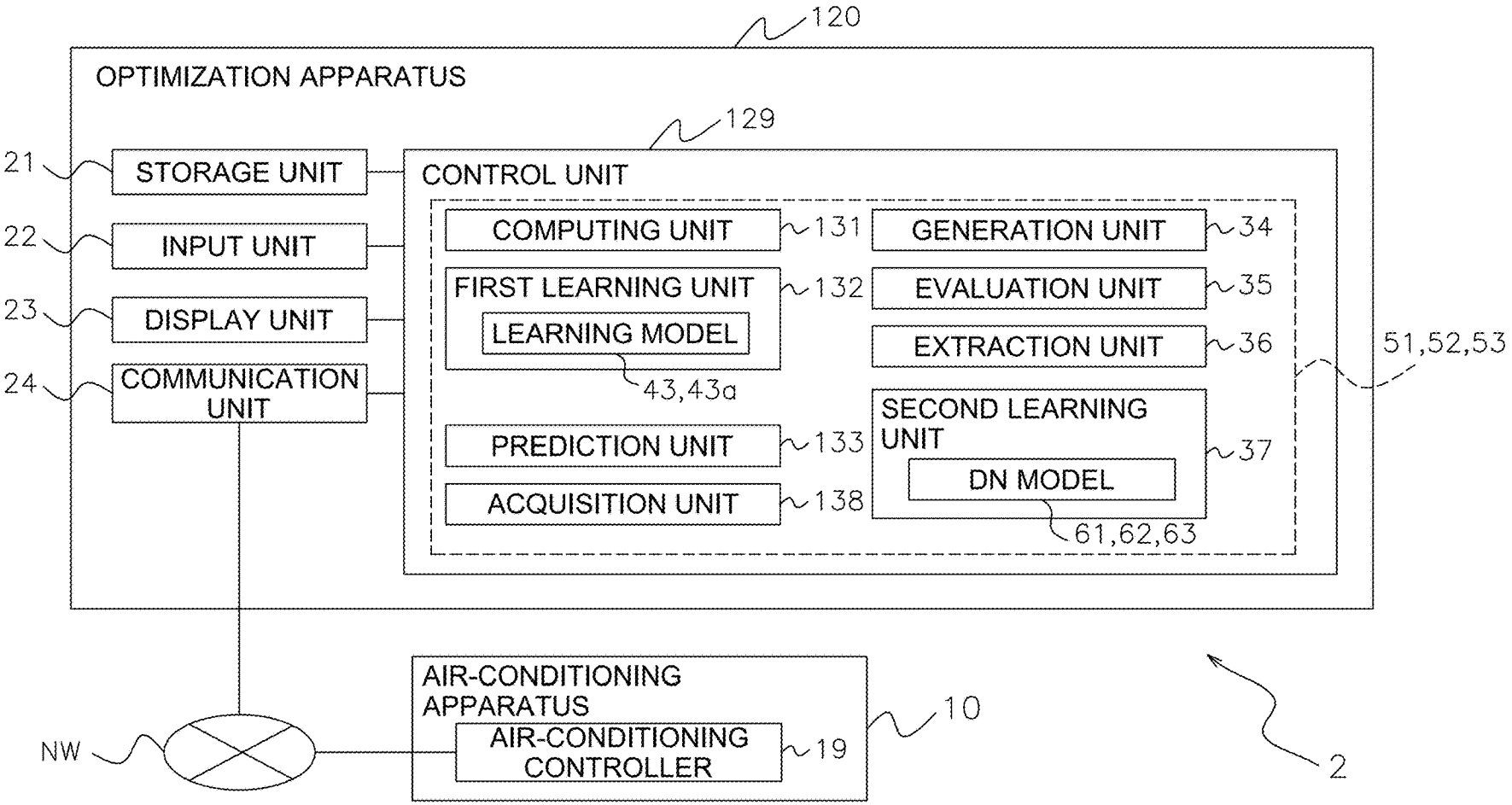
FIG. 9 is a functional block diagram of the air-conditioning control system in the second embodiment.

FIG. 9 is a functional block diagram of the air-conditioning control system 2. As shown in FIG. 9, the optimization apparatus 120 mainly includes the storage unit 21, the input unit 22, the display unit 23, the communication unit 24, and a control unit 129.

As shown in FIG. 9, the control unit 129 includes, as functional blocks, an acquisition unit 138, a computing unit 131, a first learning unit 132, a prediction unit 133, a generation unit 34, the evaluation unit 35, the extraction unit 36, and the second learning unit 37. The acquisition unit 138, the computing unit 131, the first learning unit 132, the prediction unit 133, the generation unit 34, the evaluation unit 35, the extraction unit 36, and the second learning unit 37 are functional blocks for realizing the DRL models 51 to 53.

(2-2-1) Acquisition Unit

The acquisition unit 138 acquires an actual measurement sensor value via the air-conditioning controller 19.

(2-2-2) Computing Unit

The computing unit 131 performs the CFD simulation of the measurement values of the wind speed sensors SS1 and the virtual wind speed sensors SS2, using the air-conditioning setting value as an input (hereinafter, the measurement values of the wind speed sensors SS1 subjected to the CFD simulation may be referred to as CFD sensor values, and the measurement values of the virtual wind speed sensors SS2 subjected to the CFD simulation may be referred to as CFD virtual sensor values). Here, the measurement values of the wind speed sensors SS1 and the virtual wind speed sensors SS2 subjected to the CFD simulation are the values of simulated wind speeds in the spatial meshes corresponding to the installation locations of the wind speed sensors SS1 and the virtual wind speed sensors SS2.

(2-2-3) First Learning Unit

The first learning unit 132 generates a learning model 43. The learning model 43 predicts the measurement values of the virtual wind speed sensor SS2 using, as an input, an actual measurement sensor value when the air-conditioning apparatus 10 has been controlled with a certain air-conditioning setting value.

The first learning unit 132 learns the learning model 43 in advance in three stages.

As a first step, the first learning unit 132 prepares a plurality of air-conditioning setting values. The first learning unit 132 controls the air-conditioning apparatus 10 with each of the plurality of prepared air-conditioning setting values, and acquires the actual measurement sensor value at this time. The first learning unit 132 acquires the CFD sensor value and the CFD virtual sensor value with which the CFD simulation has been performed, for each of the plurality of prepared air-conditioning setting values. The first learning unit 132 learns a learning model 43*a* by associating the CFD sensor value with the actual measurement sensor value. At this time, the first learning unit 132 learns the learning model 43*a* (first learning model) using the CFD sensor value as an explanatory variable and the actual measurement sensor value as an objective variable.

As a second stage, the first learning unit 132 inputs the CFD virtual sensor value acquired in the first stage to the learning model 43*a*, and predicts a measurement value of the virtual wind speed sensor SS2.

As a third stage, the first learning unit 132 learns the learning model 43 by associating the actual measurement sensor value acquired in the first stage with the measurement value of the virtual wind speed sensor SS2 predicted in the second stage. At this time, the first learning unit 132 learns the learning model 43 using the actual measurement sensor value as an explanatory variable and the measurement value of the virtual wind speed sensor SS2 as an objective variable. The learning model 43 is used as a learning model that predicts the measurement value of the virtual wind speed sensor SS2 using the actual measurement sensor value as an input.

The learning models 43, 43*a* are, for example, neural networks.

(2-2-4) Prediction Unit

The prediction unit 133 inputs the actual measurement sensor value when the air-conditioning apparatus 10 has been controlled with a certain air-conditioning setting value to the learning model 43, and predicts the measurement value of the virtual wind speed sensor SS2.

(2-2-5) Evaluation Unit

The variance score calculated by the evaluation unit 35 depends on the variance of a set including the actual measurement sensor value and the measurement value of the virtual wind speed sensor SS2 predicted by the learning model 43.

(3) Processing

Figure 10:
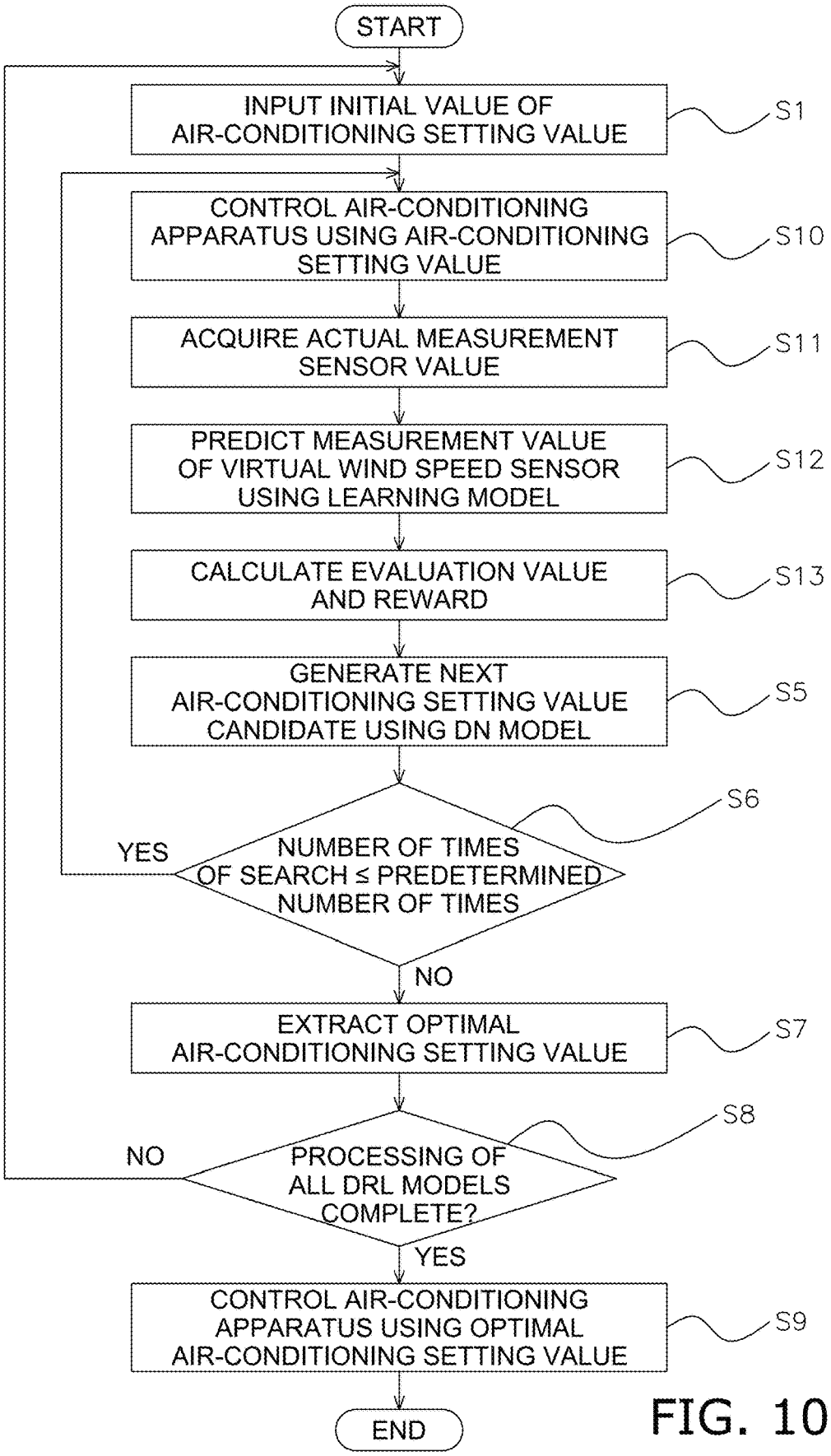
FIG. 10 is a flowchart of a process for controlling an air-conditioning apparatus with an optimal air-conditioning setting value in the second embodiment.

An example of a process of controlling the air-conditioning apparatus 10 with an optimal air-conditioning setting value will be described with reference to a flowchart of FIG. 10. The processing in steps S1 and S5 to S9 is the same as that in FIG. 7, and a description thereof will be omitted. The processing of steps S10 to S12 described below is common to the DRL models 51 to 53.

When step S1 is finished, the air-conditioning control system 2 transmits the air-conditioning setting value from the optimization apparatus 120 to the air-conditioning apparatus 10, and controls the air-conditioning apparatus 10 with the air-conditioning setting value, as indicated in step S10.

When step S10 is finished, the air-conditioning control system 2 acquires an actual measurement sensor value from the wind speed sensor SS1, as indicated in step S11.

When step S11 is finished, the air-conditioning control system 2 predicts the measurement value of the virtual wind speed sensor SS2 from the actual measurement sensor value, using the learning model 43, as indicated in step S12.

When step S12 is finished, the air-conditioning control system 2 calculates the evaluation value and the reward for the air-conditioning setting value from the actual measurement sensor value and the measurement value of the virtual wind speed sensor SS2 predicted by the learning model 43, as indicated in step S13.

(4) Features (4-1)

In the air-conditioning control system 2 of the present embodiment, the environment state is the values of the wind speeds at a plurality of locations including the installation location of the wind speed sensor SS1 and the installation location of the virtual wind speed sensor SS2 in the server room SP. The air-conditioning control system 2 further includes an acquisition unit 138. The acquisition unit 138 acquires the value of the wind speed at the installation location of the wind speed sensor SS1 by actual measurement. The learning model 43 predicts the value of the wind speed at the installation location of the virtual wind speed sensor SS2 based on the value of the wind speed at the installation location of the wind speed sensor SS1 acquired by the acquisition unit 138 when the air-conditioning apparatus 10 has been controlled with the air-conditioning setting value. The learning model 43 is a model that has performed learning using, as an explanatory variable, the value of the wind speed at the installation location of the wind speed sensor SS1 acquired by the acquisition unit 138 when the air-conditioning apparatus 10 has been controlled with the air-conditioning setting value, and, as an objective variable, the value of the wind speed at the installation location of the virtual wind speed sensor SS2.

In the air-conditioning control system 2, the learning model 43 predicts the measurement value of the virtual wind speed sensor SS2 based on the actual measurement sensor value. As a result, the air-conditioning control system 2 can predict the sensor values of all locations from the actual measurement sensor values of some locations.

(4-2)

The air-conditioning control system 2 of the present embodiment further includes a computing unit 131. The computing unit 131 performs the CFD simulation of the values of the wind speeds at the installation location of the wind speed sensor SS1 and at the installation location of the virtual wind speed sensor SS2, using the air-conditioning setting value as an input. The learning model 43 predicts the value of the wind speed at the installation location of the virtual wind speed sensor SS2 based on: the value of the wind speed at the installation location of the wind speed sensor SS1 acquired by the acquisition unit 138; and the values of the wind speeds at the installation location of the wind speed sensor SS1 and at the installation location of the virtual wind speed sensor SS2 that have been calculated by the computing unit 131. The learning model 43 is a model that has performed learning using, as an explanatory variable, the value of the wind speed at the installation location of the wind speed sensor SS1 acquired by the acquisition unit 138, and, as an objective variable, the value of the wind speed at the installation location of the virtual wind speed sensor SS2. The value of the wind speed at the installation location of the virtual wind speed sensor SS2 is predicted by inputting the value of the wind speed at the installation location of the virtual wind speed sensor SS2 calculated by the computing unit 131 to the learning model 43*a* that has performed learning using, as an explanatory variable, the value of the wind speed at the installation location of the wind speed sensor SS1 calculated by the computing unit 131, and, as an objective variable, the value of the wind speed at the installation location of the wind speed sensor SS1 acquired by the acquisition unit 138.

(5) Modifications

While an embodiment of the present disclosure has been described above, it will be understood that various changes in form and detail may be made therein without departing from the spirit and scope of the present disclosure as set forth in the appended claims.

THIRD EMBODIMENT (1) Overall Configuration

The arrangement determination apparatus 220 determines the arrangement of the air-conditioning apparatus 210 in the target space. The arrangement determination apparatus 220 determines an optimal condition for the arrangement (which may hereinafter be referred to as an arrangement condition) of the air-conditioning apparatus 210 such that the target space approaches a desired environment state.

Figure 11:
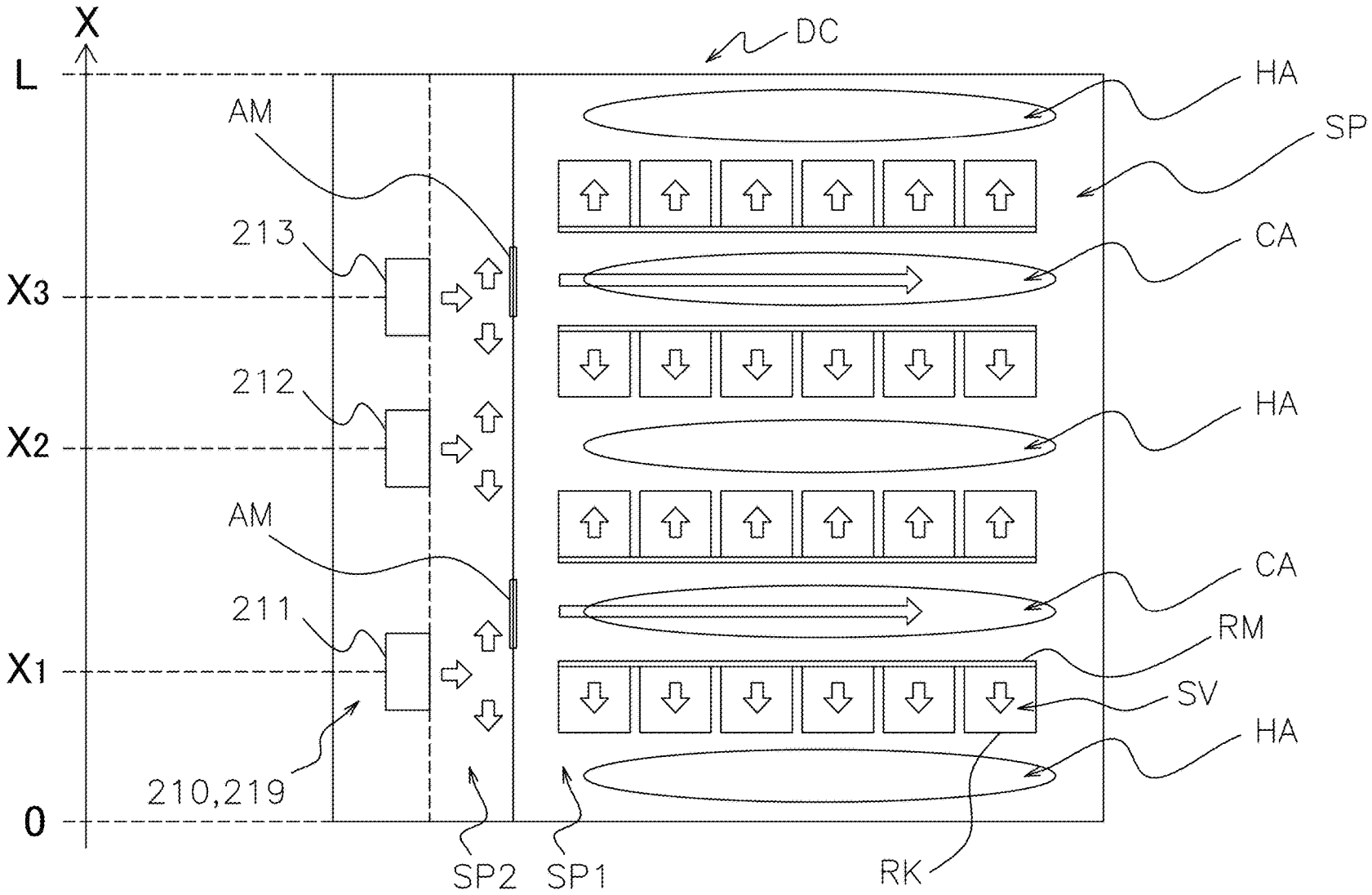
FIG. 11 is a schematic plan view of a data center in a third embodiment.
Figure 12:
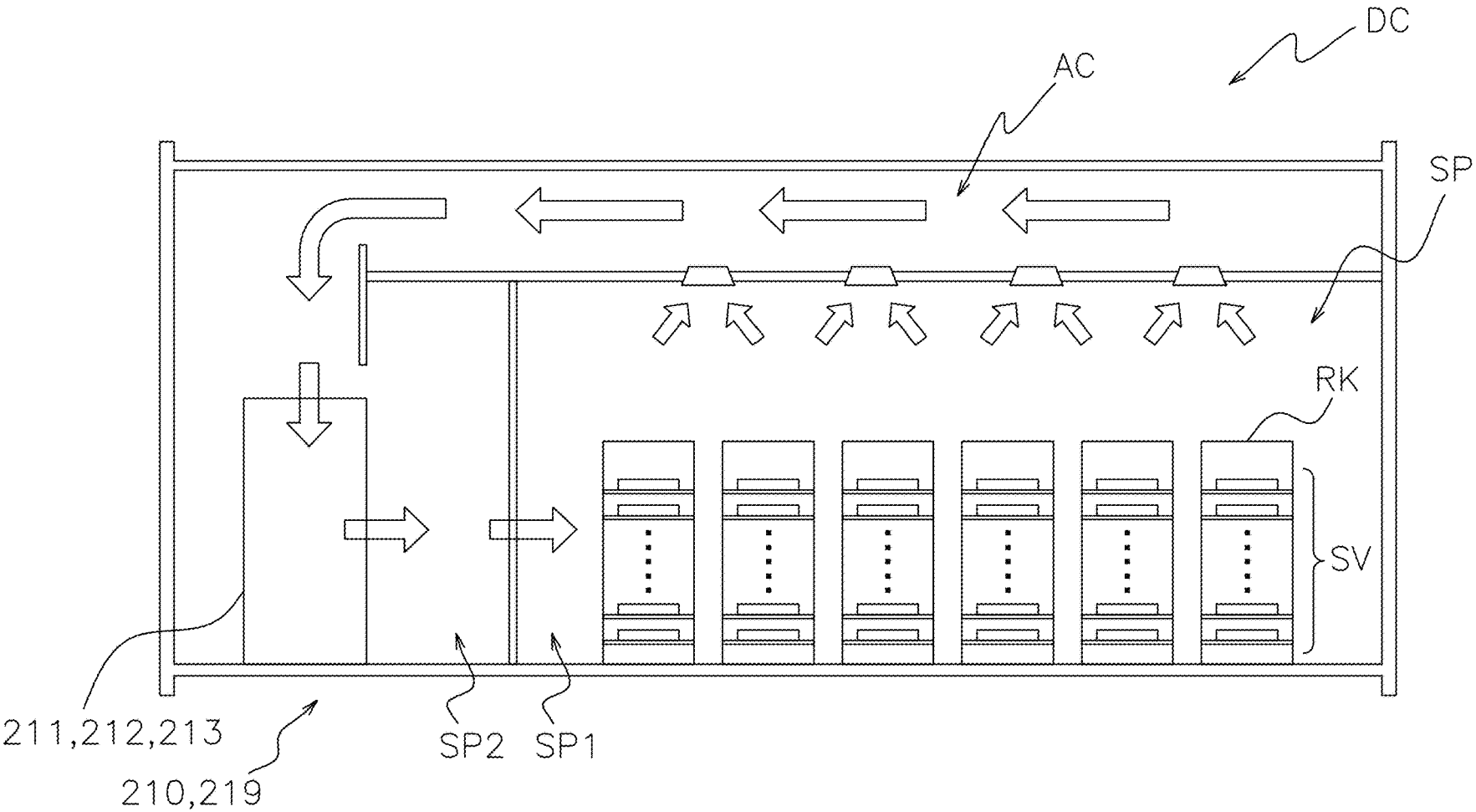
FIG. 12 is a schematic sectional view of the data center in the third embodiment.

In the present embodiment, the target space is a server room SP of a data center DC. FIG. 11 is a schematic plan view of the data center DC. FIG. 12 is a schematic cross-sectional view of the data center DC. As shown in FIGS. 11 and 12, the server room SP has a server installation area SP1 and an air conditioner installation area SP2.

In the server installation area SP1, six server racks RK are arranged in each row (hereinafter, a group of the server racks RK may be referred to as a module). On both sides of the module, there is a cold aisle CA and a hot aisle HA. Servers SV are housed in each server rack RK.

In the air conditioner installation area SP2, three indoor units 211 to 213, which are part of the air-conditioning apparatus 210, are provisionally installed. The arrangement condition of the air-conditioning apparatus 210 in the present embodiment is the position in the X-axis direction of each of the indoor units 211 to 213 in the air conditioner installation area SP2.

Two aisle meshes AM capable of adjusting the permeability of wind are stretched between the air conditioner installation area SP2 and the cold aisles CA of the server installation area SP1. Further, a rack mesh RM capable of adjusting the permeability of wind is stretched on the cold aisle CA side of each server rack RK. As indicated by the arrows in FIGS. 11 and 12, the cool wind blown out from the indoor units 211 to 213 is rectified once in the space in front of the indoor units 211 to 213. The rectified cool wind passes through the aisle meshes AM and the rack meshes RM, and is supplied to the servers SV. The air heated inside the servers SV and discharged from the servers SV travels from the hot aisles HA and is sucked back into the indoor units 211 to 213 through the attic AC.

The environment state of the server room SP is, for example, a wind speed distribution, a temperature distribution, or the like of the server room SP. In addition, a desired environment state of the server room SP is a state in which the wind speed distribution in the server room SP is uniform, a state in which the temperature distribution in the server room SP is biased toward a specific place, or the like. In the present embodiment, the desired environment state of the server room SP is a state in which the wind speed distribution in the hot aisles HA of the server room SP is uniform. The arrangement determination apparatus 220 determines an optimal arrangement condition such that the wind speed distribution in the hot aisles HA of the server room SP becomes uniform. Therefore, the arrangement determination apparatus 220 needs to predict the wind speed distribution in the server room SP from the arrangement condition. The arrangement determination apparatus 220 uses the CFD simulation to predict the wind speed distribution in the server room SP from the arrangement condition.

In the CFD simulation, the server room SP is divided into a large number of small spaces (which hereinafter may be referred to as spatial meshes), and an environment parameter such as wind speed or temperature is predicted for each spatial mesh. In the present embodiment, the environment parameter is wind speed. As the number of spatial meshes increases, a more accurate result can be obtained. However, a CFD simulation with a large number of spatial meshes requires an enormous amount of time for a single computation. On the other hand, since the servers SV are densely installed in the server racks RK in the data center DC, it is necessary to obtain a precise result, and it is not possible to reduce the number of the spatial meshes.

Therefore, in the present embodiment, the arrangement determination apparatus 220 performs a low-accuracy (in which the number of spatial meshes is relatively small) CFD simulation (which may hereinafter be referred to as a low-accuracy CFD). Then, the arrangement determination apparatus 220 performs regression prediction of the result of a high-accuracy (in which the number of spatial meshes is relatively large) CFD simulation (which may hereinafter be referred to as a high-accuracy CFD) from the result of the low-accuracy CFD. A neural network model (which may hereinafter be referred to as an NN model) is used for the regression prediction. Thus, the execution time for the high-accuracy CFD can be reduced.

Further, in the present embodiment, the arrangement determination apparatus 220 uses a reinforcement learning model (which may hereinafter be referred to as a deep reinforcement learning (DRL) model) in order to reduce the number of times of execution of the CFD simulation. The arrangement determination apparatus 220 can determine an optimal arrangement condition in a realistic time without searching all combinations of arrangement conditions.

(2) Detailed Configuration (2-1) Air-Conditioning Apparatus

Cooling (air-conditioning) of the server room SP is performed by the air-conditioning apparatus 210.

The air-conditioning apparatus 210 mainly includes the indoor units 211 to 213 and an air-conditioning controller 219.

The indoor units 211 to 213 are so-called package-type apparatuses. The indoor units 211 to 213 are installed on the floor of the air conditioner installation area SP2. Each of the indoor units 211 to 213 mainly includes a compressor, a condenser, an expansion valve, an evaporator, and a fan. The compressor, the condenser, the expansion valve, and the evaporator are connected by a refrigerant circuit.

The compressor draws in a low-pressure refrigerant, compresses the refrigerant by a compression mechanism, and discharges a compressed refrigerant. The compression mechanism of the compressor is driven by a compressor motor. The rotational speed of the compressor motor can be controlled by an inverter.

In the condenser, heat exchange is performed between the refrigerant flowing inside the condenser and, for example, water that has been cooled by a heat source unit installed on the rooftop or the like of the data center DC. At this time, the refrigerant flowing inside the condenser becomes a liquid refrigerant by condensation.

The expansion valve adjusts the pressure and flow rate of the refrigerant flowing through the refrigerant circuit. The expansion valve is an electronic expansion valve with an adjustable opening degree.

The fan supplies air in the air conditioner installation area SP2 to the evaporator. The fan is driven by a fan motor. The rotational speed of the fan motor can be controlled by an inverter.

In the evaporator, heat exchange is performed between the refrigerant flowing through the evaporator and the air in the air conditioner installation area SP2 supplied by the fan. As shown in FIG. 12, the indoor units 211 to 213 drive the fans to suck the air in the air conditioner installation area SP2 via suction ports in the upper portions of the units. The sucked air in the air conditioner installation area SP2 passes through the evaporator. At this time, the refrigerant flowing inside the evaporator becomes a gas refrigerant by evaporation. The air that has passed through the evaporator is cooled, and cool wind is blown out from the outlets of the indoor units 211 to 213.

The air-conditioning controller 219 controls the operations of various devices constituting the air-conditioning apparatus 210.

The air-conditioning controller 219 includes a control and computing apparatus and a storage apparatus. The control and computing apparatus is a processor, such as a CPU or a GPU. The storage apparatus is a storage medium, such as a RAM, a ROM, or a flash memory. The control and computing apparatus reads a program stored in the storage apparatus and performs predetermined computing processing according to the program, to thereby control the operations of various devices constituting the air-conditioning apparatus 210. In addition, the control and computing apparatus can write computation results to the storage apparatus, and read information stored in the storage apparatus according to the program.

The air-conditioning controller 219 is electrically connected to various devices constituting the air-conditioning apparatus 210 so as to be able to exchange control signals and information therewith. Further, the air-conditioning controller 219 is communicably connected to various sensors provided in the air-conditioning apparatus 210. The air-conditioning controller 219 controls various devices constituting the air-conditioning apparatus 210 with predetermined air-conditioning setting values. The air-conditioning setting values include, for example, a blown wind speed, a setting temperature, a setting humidity, and the like of each of the indoor units 211 to 213.

(2-2) Arrangement Determination Apparatus

Figure 13:
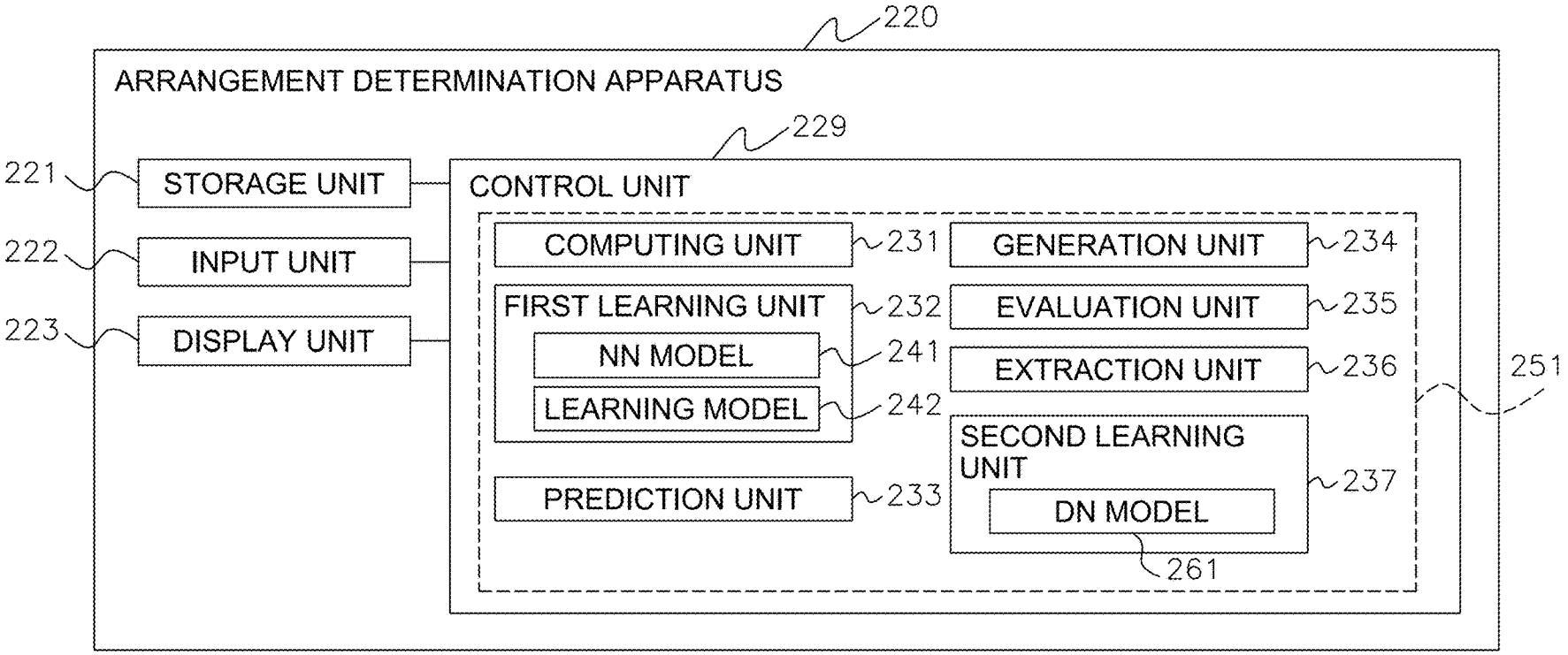
FIG. 13 is a functional block diagram of an arrangement determination apparatus in the third embodiment.

FIG. 13 is a functional block diagram of the arrangement determination apparatus 220. As shown in FIG. 3, the arrangement determination apparatus 220 mainly includes a storage unit 221, an input unit 222, a display unit 223, and a control unit 229.

(2-2-1) Storage Unit

The storage unit 221 is a storage apparatus, such as a RAM, a ROM, or a hard disk drive (HDD). The storage unit 221 stores a program executed by the control unit 229, data necessary for execution of the program, and the like.

(2-2-2) Input Unit

The input unit 222 is a keyboard and a mouse. Various commands and various information for the arrangement determination apparatus 220, such as the initial values of arrangement conditions to be searched, can be input using the input unit 222.

(2-2-3) Display Unit

The display unit 223 is a monitor. The display unit 223 can display the result of the CFD simulation, and the like.

(2-2-4) Control Unit

The control unit 229 is a processor, such as a CPU or a GPU. The control unit 229 reads and executes a program stored in the storage unit 221 to implement various functions of the arrangement determination apparatus 220. Further, the control unit 229 can write a computation result to the storage unit 221, or read information stored in the storage unit 221 according to a program.

As shown in FIG. 13, the control unit 229 includes, as functional blocks, a computing unit 231, a first learning unit 232, a prediction unit 233, a generation unit 234, an evaluation unit 235, an extraction unit 236, and a second learning unit 237. The computing unit 231, the first learning unit 232, the prediction unit 233, the generation unit 234, the evaluation unit 235, the extraction unit 236, and the second learning unit 237 are functional blocks for realizing a DRL model 251.

(2-2-4-1) Computing Unit

The computing unit 231 performs a CFD simulation of the wind speed distribution in the server room SP using, as inputs, the arrangement condition, the transmittance of each of the aisle meshes AM and the rack meshes RM, and the air-conditioning setting value. In the present embodiment, the transmittance of each of the aisle meshes AM and the rack meshes RM and the air-conditioning setting values are fixed to predetermined values. Therefore, the computing unit 231 substantially performs the CFD simulation of the wind speed distribution in the server room SP using the arrangement condition as an input.

The arrangement condition in the present embodiment is the position of each of the indoor units 211 to 213 in the X-axis direction. Each element of the arrangement condition satisfies the condition of the following Expression 6.

MATH 6

$$S = (X_1, X_2, X_3) \quad \text{MATH 6}$$

$$X_1, X_2, X_3 \in [0, L]$$

$$X_1 < X_2 < X_3$$

where S indicates the arrangement condition, $X_1$ to $X_3$ respectively indicate the X-axis coordinates of the indoor units 211 to 213, and L indicates the length of the server room SP in the X-axis direction.

Software for performing the CFD simulation is, for example, Flow Designer provided by Advanced Knowledge Laboratory. The result of the CFD simulation (wind speed for each spatial mesh) is output to a CSV file or the like.

The computing unit 231 calculates a wind speed distribution of high accuracy (which may hereinafter be referred to as a high-accuracy wind speed distribution) that is the result of a high-accuracy CFD of the server room SP, and a wind speed distribution of low accuracy (which may hereinafter be referred to as a low-accuracy wind speed distribution) that is the result of the low-accuracy CFD of the server room SP.

When searching for an optimal arrangement condition, the computing unit 231 calculates the low-accuracy wind speed distribution to be input to the distribution to the NN model 241, for each arrangement condition searched. In addition, in order to learn the NN model 241 in advance, the computing unit 231 calculates a pair of the low-accuracy wind speed distribution and the high-accuracy wind speed distribution (a learning data set of the NN model 241) for each of a plurality of arrangement conditions.

(2-2-4-2) First Learning Unit

The first learning unit 232 generates the NN model 241 using the learning data set of the NN model 241 calculated by the computing unit 231. At this time, the first learning unit 232 learns the NN model 241 with the low-accuracy wind speed distribution as an explanatory variable and the high-accuracy wind speed distribution as an objective variable.

(2-2-4-3) Prediction Unit

The prediction unit 233 predicts the high-accuracy wind speed distribution using the NN model 241 generated by the first learning unit 232. Specifically, the prediction unit 233 inputs the low-accuracy wind speed distribution, calculated by the computing unit 231 based on the arrangement condition, to the NN model 241, and predicts the high-accuracy wind speed distribution.

(2-2-4-4) Generation Unit

In the present embodiment, the DRL model 251 is used as a technique for searching for the optimal arrangement condition. In the present embodiment, in the DRL model 251, a learning model that is used for selecting the next action is a dueling network model 261 (which may hereinafter be referred to as a DN model 261).

A state (arrangement condition) and an action in the DRL model 251 are represented by the following Expression 7.

MATH 7

$$S = (X_1, X_2, X_3) \quad \text{MATH 7}$$

$$a \in \{X_1^+, X_1^-, X_2^+, X_2^-, X_3^+, X_3^-\}$$

where S indicates the state, a indicates the action, and $X_1^+$ or the like indicates the action of increasing or decreasing the corresponding arrangement condition by the search range.

The generation unit 234 generates candidates for arrangement conditions to be searched, using the DRL model 251 having the evaluation by the evaluation unit 235 as a value (reward). Specifically, the generation unit 234 generates candidates for arrangement conditions having a high expected reward, using the DN model 61 that determines a candidate for the next arrangement condition based on the current arrangement condition.

(2-2-4-5) Evaluation Unit

The evaluation unit 235 evaluates the high-accuracy wind speed distribution corresponding to the arrangement condition.

The evaluation unit 235 first calculates an evaluation value of the arrangement condition based on the arrangement condition and the high-accuracy wind speed distribution corresponding to the arrangement condition.

The evaluation value is defined, for example, by the following Expression (8).

MATH 8

$$\text{Evaluation value} = \alpha \times \text{variance score} + \beta \times \text{mesh score} + \gamma \times \text{air-conditioning score}$$

$$\text{Variance score} = f(\text{var(server backside wind speed)})$$

$$\text{Mesh score} = g(M_{aisle} + M_{rack})$$

$$\text{Air-conditioning score} = h((P_1)^3 + (P_2)^3 + (P_3)^3) \quad \text{<Math. 8>}$$

$$\alpha + \beta + \gamma = 1 (\alpha = 0.6, \beta = 0.1, \gamma = 0.3)$$

The evaluation value is obtained by averaging the variance score, the mesh score, and the air-conditioning score with weights α, β, and γ. Each of the variance score, the mesh score, and the air-conditioning score is configured to take a value of 0 or more and 100 or less (as a result, the evaluation value also takes a value of 0 or more and 100 or less). The larger the evaluation value, the variance score, the mesh score, and the air-conditioning score are, the higher the evaluation is.

The variance score depends on the variance of a set of wind speeds, included in the high-accuracy wind speed distribution, for the specific spatial mesh present on the back side (hot aisle HA side) of each server SV. The variance score is configured to have a larger value as the variance becomes smaller. The variance score represents the uniformity of the wind speed distribution in the hot aisles HA in the server room SP. As the variance score increases, the hot aisles HA of the server room SP have a more uniform wind speed distribution.

The mesh score depends on the sum of the transmittance of the aisle meshes AM and the transmittance of the rack meshes RM. The mesh score is configured to have a larger value as the transmittance of the aisle meshes AM or the transmittance of the rack meshes RM increases. As the mesh score increases, wind passes through the aisle meshes AM and the rack meshes RM more easily, and thus the variance score decreases.

The air-conditioning score depends on the sum of the cube of the blown wind speed of each of the indoor units 211 to 213. The air-conditioning score is configured to increase as the blown wind speed of the indoor units 211 to 213 decreases (as the power consumption of the air-conditioning apparatus 210 decreases). The air-conditioning score is defined in this way because the power consumption of the air-conditioning apparatus 210 is proportional to the cube of the blown wind speed.

In the present embodiment, since homogenization of the wind speed distribution in the hot aisles HA is emphasized, $\alpha$ is set to 0.6 (which is a relatively large value), $\beta$ is set to 0.1, and $\gamma$ is set to 0.3.

After calculating the evaluation value, the evaluation unit 235 calculates a reward for the DRL model 251 based on the evaluation value, for example, as shown in Table 6 below.

TABLE 6

| Conditions | Reward |
|---|---|
| If the current evaluation value is larger than the average of the evaluation values of the past 10 steps. | 1 |
| If the current evaluation value is equal to or less than the average of the evaluation values of the past 10 steps. | 0 |
| If the search for the air-conditioning setting value has gone outside the predetermined search range. | −3 |

In the present embodiment, the DRL model 251 is stabilized by comparing the current evaluation value with the average of the evaluation values of the past 10 steps.

(2-2-4-6) Extraction Unit

The extraction unit 236 extracts an optimal arrangement condition having the highest evaluation value by the evaluation unit 235, from among the plurality of arrangement condition candidates generated by the generation unit 234.

(2-2-4-7) Second Learning Unit

During the search by the DRL model 251, the second learning unit 237 associates the state with the reward that is expected when each action is taken from the state, and stocks the state and the reward in the storage unit 221.

The second learning unit 237 uses the above data stocked in the storage unit 221 to learn and update the DN model 261, as needed.

(3) Processing

Figure 14:
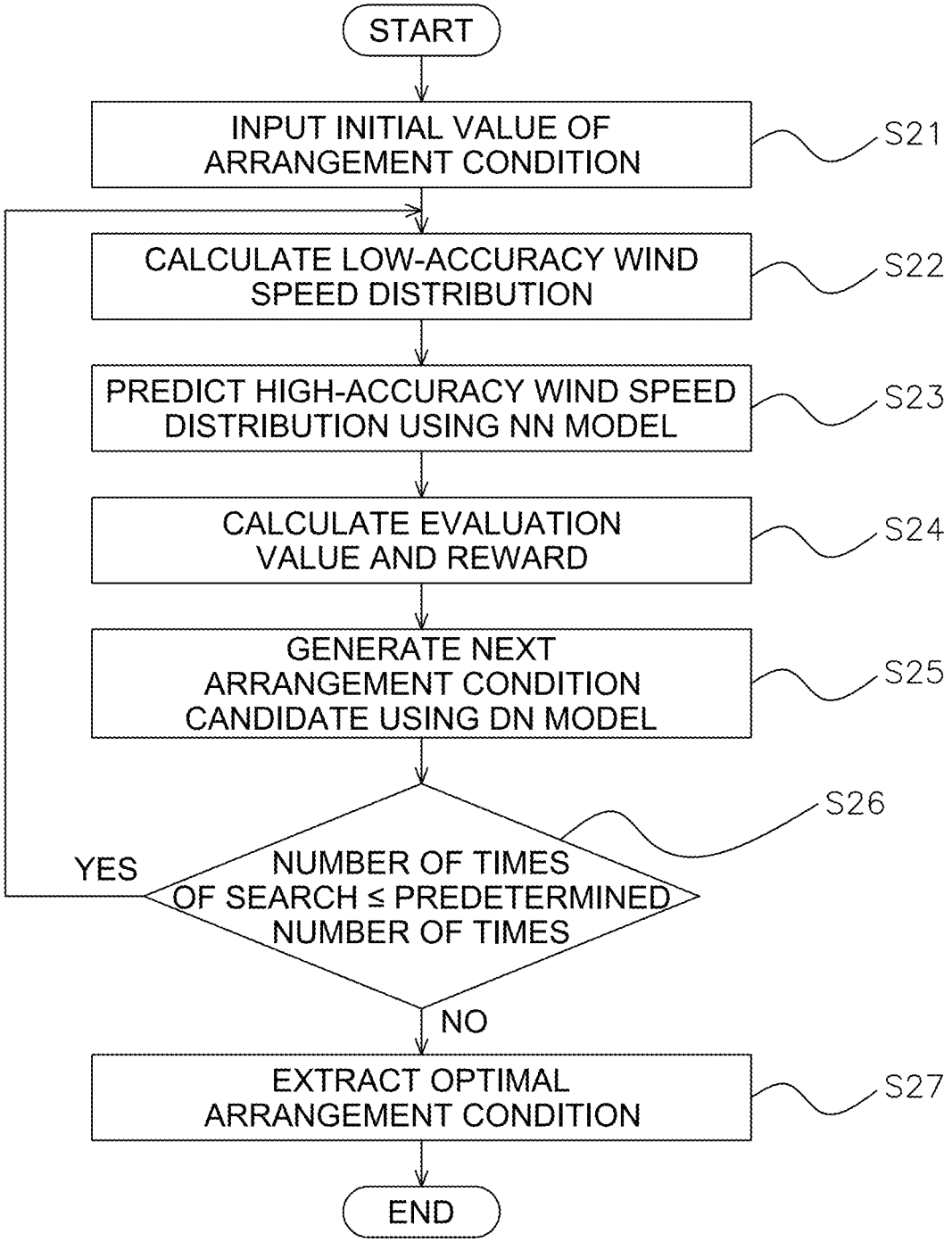
FIG. 14 is a flowchart of a process for determining optimal arrangement conditions in the third embodiment.

An example of the processing for determining the optimal arrangement condition will be described with reference to the flowchart of FIG. 14.

As indicated in step S21, the initial values of the arrangement condition are input to the arrangement determination apparatus 220.

When step S21 is finished, the arrangement determination apparatus 220 calculates the low-accuracy wind speed distribution from the arrangement condition, as indicated in step S22.

When step S22 is finished, the arrangement determination apparatus 220 predicts the high-accuracy wind speed distribution from the low-accuracy wind speed distribution using the NN model 241, as indicated in step S23.

When step S23 is finished, the arrangement determination apparatus 220 calculates the evaluation value and the reward for the arrangement condition, from the arrangement condition and the high-accuracy wind speed distribution, as indicated in step S24.

When step S24 is finished, the arrangement determination apparatus 220 generates candidates for an arrangement condition having a high expected reward, using the DN model 261, as indicated in step S25.

When step S25 is finished, the arrangement determination apparatus 220 determines whether or not the number of times of search by the DRL model 251 is equal to or less than a predetermined number of times (the total number of times of search by the DRL model 251 set in advance), as indicated in step S26. If the number of times of search by the DRL model 251 is equal to or less than the predetermined number of times, the process proceeds to step S22. If the number of times of search by the DRL model 251 is larger than the predetermined number of times, the process proceeds to step S27.

When the process proceeds from step S26 to step S22, the arrangement determination apparatus 220 calculates the low-accuracy wind speed distribution from the arrangement condition generated in step S25. In other words, the arrangement determination apparatus 220 repeats steps S22 to S26 until the number of times of search by the DRL model 251 becomes larger than the predetermined number of times.

When the process proceeds from step S26 to step S27, the arrangement determination apparatus 220 extracts an optimal arrangement condition having the highest evaluation value from among the arrangement conditions searched in the DRL model 251.

The arrangement determination apparatus 220 learns and updates the DN model 261, as needed, during the processing of the DRL model 251.

(4) Features (4-1)

When a data center is designed or when a module is added to a server room, it is necessary to determine the optimal arrangement condition of the air-conditioning apparatus so that the server room is in the desired environment state.

The arrangement determination apparatus 220 of the present embodiment determines the arrangement of the air-conditioning apparatus 210 in the server room SP. The arrangement determination apparatus 220 includes the generation unit 234, the first learning unit 232, the prediction unit 233, the evaluation unit 235, and the extraction unit 236. The generation unit 234 generates a plurality of candidates for the arrangement condition of the air-conditioning apparatus 210. The first learning unit 232 generates the NN model 241. The prediction unit 233 predicts the wind speed distribution using the NN model 241. The NN model 241 predicts the wind speed distribution in the server room SP based on the arrangement condition. The evaluation unit 235 evaluates the wind speed distribution corresponding to the arrangement condition. The extraction unit 236 extracts an arrangement condition having the highest evaluation by the evaluation unit 235 from among the plurality of arrangement condition candidates.

The arrangement determination apparatus 220 extracts an arrangement condition based on the wind speed distribution in the server room SP. As a result, the arrangement determination apparatus 220 can determine an optimal arrangement condition such that the server room SP approaches a desired wind speed distribution.

(4-2)

The arrangement determination apparatus 220 of the present embodiment further includes the computing unit 231. The computing unit 231 performs the CFD simulation of the wind speed distribution using the arrangement condition as an input. The computing unit 231 calculates the high-accuracy wind speed distribution and the low-accuracy wind speed distribution. The NN model 241 predicts the high-accuracy wind speed distribution using the low-accuracy wind speed distribution as an input.

The arrangement determination apparatus 220 performs the CFD simulation of the wind speed distribution in the server room SP using the arrangement condition as an input. The arrangement determination apparatus 220 calculates the low-accuracy wind speed distribution from the arrangement condition. The arrangement determination apparatus 220 predicts the high-accuracy wind speed distribution from the low-accuracy wind speed distribution using the NN model 241.

Therefore, the arrangement determination apparatus 220 can reduce the time required for the CFD simulation as compared with the case where the high-accuracy wind speed distribution is calculated from the arrangement condition. As a result, the arrangement determination apparatus 220 can determine an optimal arrangement condition such that the server room SP approaches a desired wind speed distribution in a realistic time.

(4-3)

In the arrangement determination apparatus 220 of the present embodiment, the generation unit 234 generates arrangement condition candidates by reinforcement learning in which the evaluation by the evaluation unit 235 is used as a value.

As a result, the arrangement determination apparatus 220 can determine an optimal air-conditioning setting value such that the server room SP approaches a desired wind speed distribution, without depending on the experience of the operator and without generating candidates for all arrangement conditions.

(4-4)

In the arrangement determination apparatus 220 of the present embodiment, the generation unit 234 generates the arrangement condition candidates using the DN model 261 that determines the next arrangement condition candidate based on the current arrangement condition.

As a result, the arrangement determination apparatus 220 can easily generate optimal arrangement condition candidates using the DRL model 251 in which the DN model 261 is used, even when the number of elements of the arrangement condition is large.

(4-5)

In the arrangement determination apparatus 220 of the present embodiment, the target space includes the aisles between the server racks RK in the data center DC.

As a result, the arrangement determination apparatus 220 can suppress the power consumption of the servers SV by bringing the wind speed distribution of the cold aisles CA or the hot aisles HA of the server room SP closer to a desired wind speed distribution.

(5) Modifications (5-1) Modification 1A

In the present embodiment, the air-conditioning apparatus 210 performs air-conditioning of the server room SP using the floor-standing and package-type indoor units 11 to 13. However, the air-conditioning apparatus 210 may perform air-conditioning of the server room SP by a so-called building multi-system or a central air-conditioning system. Further, the indoor units 211 to 213 may be of ceiling-mounted type or wall-mounted type.

(5-2)

In the present embodiment, the target space of the arrangement determination apparatus 220 is the server room SP in the data center DC. However, the target space of the arrangement determination apparatus 220 may be a space in a commercial facility, an office space, or the like.

(5-3)

In the present embodiment, the arrangement determination apparatus 220 fixes the orientations of the outlets of the indoor units 211 to 213, and searches the arrangement conditions in a one-dimensional manner. However, the arrangement determination apparatus 220 may search the arrangement conditions in a two-dimensional or three-dimensional manner in consideration of the translational degree of freedom and the rotational degree of freedom.

(5-4)

In the present embodiment, the arrangement determination apparatus 220 calculates the low-accuracy wind speed distribution from the arrangement condition, and inputs the low-accuracy wind speed distribution to the NN model 241 to thereby predict the high-accuracy wind speed distribution. However, the arrangement determination apparatus 220 may use the learning model 242 that predicts the high-accuracy wind speed distribution using the arrangement condition as an input. The learning model 242 is, for example, a neural network.

In this case, the computing unit 231 calculates the high-accuracy wind speed distribution (a learning data set of the learning model 242) for each plurality of arrangement conditions in order to learn the learning model 242 in advance.

The first learning unit 232 generates the learning model 42 using the learning data set of the learning model 242 calculated by the computing unit 231. At this time, the first learning unit 232 learns the learning model 242 using the arrangement condition as an explanatory variable and the high-accuracy wind speed distribution as an objective variable.

The prediction unit 233 predicts the high-accuracy wind speed distribution using the learning model 242 generated by the first learning unit 232. Specifically, the prediction unit 233 inputs the arrangement condition to the learning model 242, and predicts the high-accuracy wind speed distribution.

As a result, the arrangement determination apparatus 220 can determine an optimal arrangement condition such that the server room SP approaches a desired wind speed distribution, without actually operating the air-conditioning apparatus 210 for each arrangement condition.

(5-5)

While the embodiments of the present disclosure have been described above, it will be understood that various changes in form and detail may be made therein without departing from the spirit and scope of the present disclosure as set forth in the appended claims.

What is claimed is:

1. An air-conditioning control system for performing air-conditioning of a target space by an air-conditioning apparatus, the air-conditioning control system comprising:

a processor including a generation unit configured to generate a plurality of candidates for an operation condition of the air-conditioning apparatus;

a prediction unit configured to use a learning model in order to predict an environment state of the target space based on the operation condition, to predict the environment state;

an evaluation unit configured to evaluate the environment state corresponding to the operation condition;

an extraction unit configured to extract, from the plurality of candidates for the operation condition, the operation condition for which an evaluation by the evaluation unit satisfies a predetermined condition;

a control unit configured to control the air-conditioning apparatus with the operation condition extracted by the extraction unit; and a computing unit configured to perform a computational fluid dynamics simulation of the environment state using the operation condition as an input, the learning model being configured to predict the environment state that is an output of the computational fluid dynamics simulation, using the operation condition as an input, and the learning model having performed learning using the operation condition as an explanatory variable, and the environment state that is the output of the computational fluid dynamics simulation as an objective variable.

2. The air-conditioning control system according to claim 1, wherein the processor further includes a learning unit configured to generate the learning model.

3. The air-conditioning control system according to claim 1, wherein the generation unit is configured to generate the candidates for the operation condition by reinforcement learning in which an evaluation by the evaluation unit is used as a value.

4. The air-conditioning control system according to claim 3, wherein the generation unit is configured to generate the candidates for the operation condition using a learning model that determines a candidate for a next operation condition based on the current operation condition.

5. The air-conditioning control system according to claim 1, wherein the target space includes an aisle between server racks in a data center.

6. The air-conditioning control system according to claim 2, wherein the processor further includes a computing unit configured to perform a computational fluid dynamics simulation of the environment state using the operation condition as an input, the learning model being configured to predict the environment state that is an output of the computational fluid dynamics simulation, using the operation condition as an input.

7. The air-conditioning control system according to claim 2, wherein the processor further includes a computing unit configured to perform a computational fluid dynamics simulation of the environment state using the operation condition as an input, the computing unit being configured to calculate a first environment state and a second environment state having a lower simulation accuracy than the first environment state, and the learning model being configured to predict the first environment state using the second environment state as an input.

8. The air-conditioning control system according to claim 2, wherein the processor further includes an acquisition unit, the environment state being a value of an environment parameter at a plurality of locations including a first location and a second location in the target space, the acquisition unit being configured to acquire the value of the environment parameter at the first location by actual measurement, and the learning model being configured to predict the value of the environment parameter at the second location based on the value of the environment parameter at the first location acquired by the acquisition unit when the air-conditioning apparatus has been controlled with the operation condition.

9. The air-conditioning control system according to claim 2, wherein the generation unit is configured to generate the candidates for the operation condition by reinforcement learning in which an evaluation by the evaluation unit is used as a value.

10. The air-conditioning control system according to claim 2, wherein the target space includes an aisle between server racks in a data center.

11. An air-conditioning control system for performing air-conditioning of a target space by an air-conditioning apparatus, the air-conditioning control system comprising:

a processor including a generation unit configured to generate a plurality of candidates for an operation condition of the air-conditioning apparatus;

a prediction unit configured to use a learning model in order to predict an environment state of the target space based on the operation condition, to predict the environment state;

an evaluation unit configured to evaluate the environment state corresponding to the operation condition;

an extraction unit configured to extract, from the plurality of candidates for the operation condition, the operation condition for which an evaluation by the evaluation unit satisfies a predetermined condition;

a control unit configured to control the air-conditioning apparatus with the operation condition extracted by the extraction unit; and a computing unit configured to perform a computational fluid dynamics simulation of the environment state using the operation condition as an input, the computing unit being configured to calculate a first environment state and a second environment state having a lower simulation accuracy than the first environment state, and the learning model being configured to predict the first environment state using the second environment state as an input, and the learning model having performed learning using the second environment state as an explanatory variable and the first environment state as an objective variable.

12. An air-conditioning control system for performing air-conditioning of a target space by an air-conditioning apparatus, the air-conditioning control system comprising:

a processor including a generation unit configured to generate a plurality of candidates for an operation condition of the air-conditioning apparatus;

a prediction unit configured to use a learning model in order to predict an environment state of the target space based on the operation condition, to predict the environment state;

an evaluation unit configured to evaluate the environment state corresponding to the operation condition;

an extraction unit configured to extract, from the plurality of candidates for the operation condition, the operation condition for which an evaluation by the evaluation unit satisfies a predetermined condition;

a control unit configured to control the air-conditioning apparatus with the operation condition extracted by the extraction unit;

an acquisition unit, the environment state being a value of an environment parameter at a plurality of locations including a first location and a second location in the target space, the acquisition unit being configured to acquire the value of the environment parameter at the first location by actual measurement; and a computing unit configured to perform a computational fluid dynamics simulation of the values of the environment parameters at the first location and the second location, using the operation conditions as an input, the learning model being configured to predict the value of the environment parameter at the second location based on the value of the environment parameter at the first location acquired by the acquisition unit when the air-conditioning apparatus has been controlled with the operation condition, and the values of the environment parameter at the first location and the second location calculated by the computing unit, and the learning model having performed learning using, as an explanatory variable, the value of the environment parameter at the first location acquired by the acquisition unit, and, as an objective variable, the value of the environment parameter at the second location predicted by inputting the value of the environment parameter at the second location calculated by the computing unit to a first learning model that has performed learning using, as an explanatory variable, the value of the environment parameter at the first location calculated by the computing unit, and, as an objective variable, the value of the environment parameter at the first location acquired by the acquisition unit.

13. The air-conditioning control system according to claim 12, wherein the learning model has performed learning using, as an explanatory variable, the value of the environment parameter at the first location acquired by the acquisition unit when the air-conditioning apparatus has been controlled with the operation condition, and, as an objective variable, the value of the environment parameter at the second location.

* * * * *